US008375669B2

(12) United States Patent
Krayenhoff

(10) Patent No.: US 8,375,669 B2
(45) Date of Patent: Feb. 19, 2013

(54) FORMWORK AND METHOD FOR CONSTRUCTING RAMMED EARTH WALLS

(75) Inventor: Meror Krayenhoff, Salt Spring Island (CA)

(73) Assignee: SIREwall Inc., Salt Spring Island, British Columbia (CA)

( * ) Notice: Subject to any disclaimer, the term of this patent is extended or adjusted under 35 U.S.C. 154(b) by 583 days.

(21) Appl. No.: 12/377,853

(22) PCT Filed: Aug. 18, 2006

(86) PCT No.: PCT/CA2006/001360

§ 371 (c)(1),
(2), (4) Date: Feb. 17, 2009

(87) PCT Pub. No.: WO2008/019463

PCT Pub. Date: Feb. 21, 2008

(65) Prior Publication Data

US 2010/0176525 A1 Jul. 15, 2010

(51) Int. Cl.
*E04B 2/00* (2006.01)

(52) U.S. Cl. ..... 52/429; 52/745.09; 52/741.13; 52/581; 52/424; 52/309.11; 249/33; 249/38; 249/163

(58) Field of Classification Search ..... 52/45.09, 52/745.01, 741.14, 742.1, 424, 425, 426, 52/427, 428, 429, 580, 581, 745.09, 309.11, 52/741.13, 742.13; 249/33, 34, 38, 40, 45, 249/190, 219.2, 163, 165; 264/35; 405/284, 405/271

See application file for complete search history.

(56) References Cited

U.S. PATENT DOCUMENTS

| | | | | | |
|---|---|---|---|---|---|
| 1,602,575 | A | * | 10/1926 | Franson | 249/47 |
| 1,632,846 | A | * | 6/1927 | Penote | 249/186 |
| 1,636,256 | A | * | 7/1927 | Strom | 249/37 |
| 1,664,884 | A | * | 4/1928 | Hollis | 264/35 |
| 2,379,636 | A | * | 7/1945 | Hedgren | 52/745.05 |
| 2,400,852 | A | | 5/1946 | Stevenson | |
| 2,496,616 | A | * | 2/1950 | Barton | 264/33 |
| 3,344,572 | A | * | 10/1967 | Sell | 52/426 |

(Continued)

FOREIGN PATENT DOCUMENTS

| | | |
|---|---|---|
| AU | 545322 | 5/1982 |
| AU | 561883 | 7/1986 |

(Continued)

OTHER PUBLICATIONS

Koel, Kenneth, "Concrete Formwork", 1988, Chapter 5, pp. 105-152, American Technical Publishers Inc., United States of America.

(Continued)

*Primary Examiner* — Robert Canfield
*Assistant Examiner* — Matthew Gitlin
(74) *Attorney, Agent, or Firm* — Smiths IP; Dana Turner-Ryan

(57) ABSTRACT

The invention is a formwork system and a method of using the formwork to construct rammed earth walls. The formwork comprises end panels which can be quickly assembled and disassembled to provide end stops to support side panels without the need for through-ties. The end panels comprise integral handholds for access to the full height of the formwork. The end panels are stackable, rotatable and interchangeable, such that one set of formwork may be used to create several different wall configurations. The finished wall contains an internal support structure and insulating core, without through-holes.

59 Claims, 34 Drawing Sheets

U.S. PATENT DOCUMENTS

| | | | | |
|---|---|---|---|---|
| 3,833,199 | A * | 9/1974 | Frake | 249/33 |
| 4,075,852 | A * | 2/1978 | Tamaro | 405/267 |
| 4,086,739 | A * | 5/1978 | Hall | 52/281 |
| 4,106,743 | A | 8/1978 | Dendinger | |
| 4,263,765 | A * | 4/1981 | Maloney | 52/562 |
| 4,702,053 | A | 10/1987 | Hibbard | |
| 4,768,324 | A | 9/1988 | Hibbard | |
| 4,784,365 | A * | 11/1988 | Scott | 249/21 |
| 5,021,202 | A * | 6/1991 | Novotny | 264/33 |
| 5,029,804 | A * | 7/1991 | McGregor | 249/20 |
| 5,488,806 | A * | 2/1996 | Melnick et al. | 52/425 |
| 6,240,700 | B1 * | 6/2001 | Sheu | 52/741.13 |
| 6,263,628 | B1 | 7/2001 | Griffin | |
| 6,601,820 | B2 * | 8/2003 | Gates | 249/191 |
| 6,718,722 | B2 | 4/2004 | Worrell et al. | |
| 6,931,806 | B2 * | 8/2005 | Olsen | 52/309.11 |
| 7,033,116 | B1 * | 4/2006 | Ward et al. | 405/229 |
| 7,628,570 | B2 * | 12/2009 | Davidsaver et al. | 405/284 |
| 7,854,574 | B2 * | 12/2010 | Heselden | 405/284 |
| 8,033,759 | B2 * | 10/2011 | Davidsaver et al. | 405/284 |
| 2003/0014933 | A1 * | 1/2003 | Worley | 52/426 |
| 2003/0146366 | A1 * | 8/2003 | Hufnagel | 249/33 |
| 2004/0096276 | A1 * | 5/2004 | Startteim et al. | 405/129.8 |
| 2004/0261326 | A1 * | 12/2004 | Thomason et al. | 52/79.1 |
| 2005/0023432 | A1 * | 2/2005 | Huber et al. | 249/34 |
| 2005/0053429 | A1 * | 3/2005 | Davidsaver et al. | 405/284 |
| 2007/0017174 | A1 * | 1/2007 | Lavell | 52/267 |
| 2007/0094967 | A1 * | 5/2007 | Kosny et al. | 52/309.9 |
| 2007/0217870 | A1 * | 9/2007 | Davidsaver et al. | 405/284 |
| 2007/0286688 | A1 * | 12/2007 | Bradley | 405/276 |
| 2008/0005991 | A1 * | 1/2008 | Meilleur et al. | 52/426 |
| 2009/0107065 | A1 * | 4/2009 | LeBlang | 52/252 |
| 2010/0034598 | A1 * | 2/2010 | Davidsaver et al. | 405/284 |
| 2010/0071141 | A1 * | 3/2010 | Reiner | 14/73 |

FOREIGN PATENT DOCUMENTS

| | | |
|---|---|---|
| CA | 2012959 | 9/1991 |
| NZ | 236182 | 3/1994 |

OTHER PUBLICATIONS

Hurd, M.K, "Formwork for Concrete", 1995, Chapter 9, pp. 9-1-9-84, 6th Edition, American Concrete Institute, United States of America.

Easton, David; The Rammed Earth House; 1996, Chapter 7, "The Art of Formbuilding", pp. 105-131, Chelsea Green Publishing Company, United States of America.

Waitakere City Council; "Earth Building"; 2008, pp. 1-20, www.waitakere.govt.nz/Abtcit/ec/bldsus/pdf/materials/earthbuilding.pdf, New Zealand.

* cited by examiner

Fig. 7
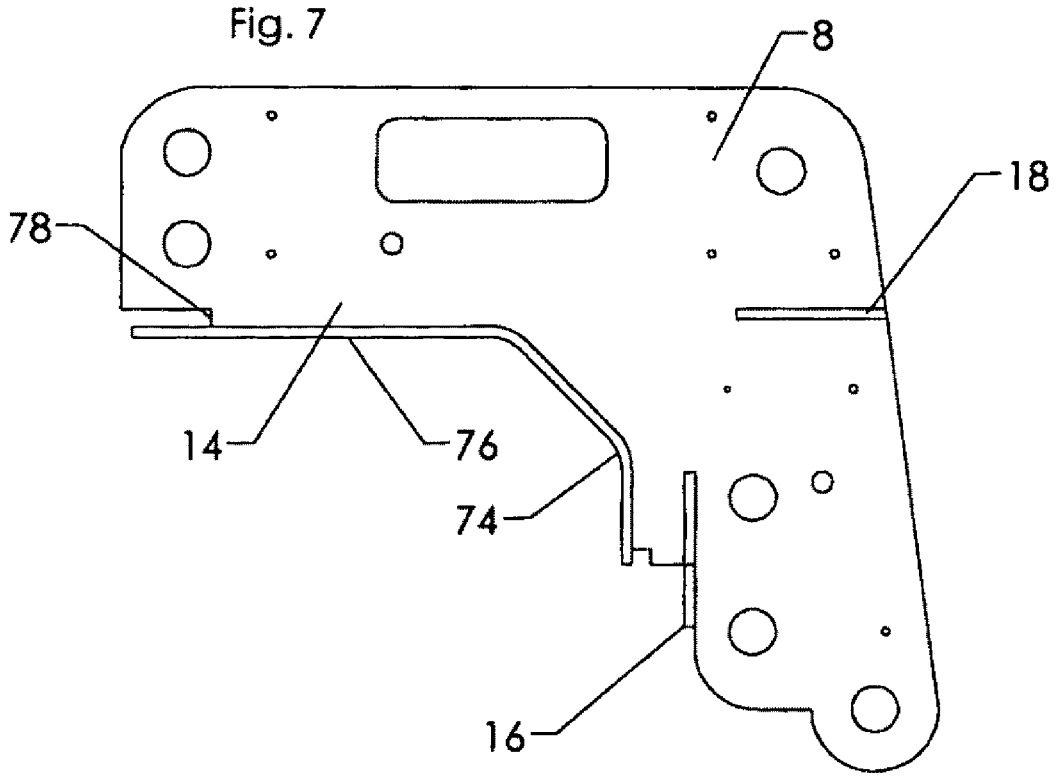
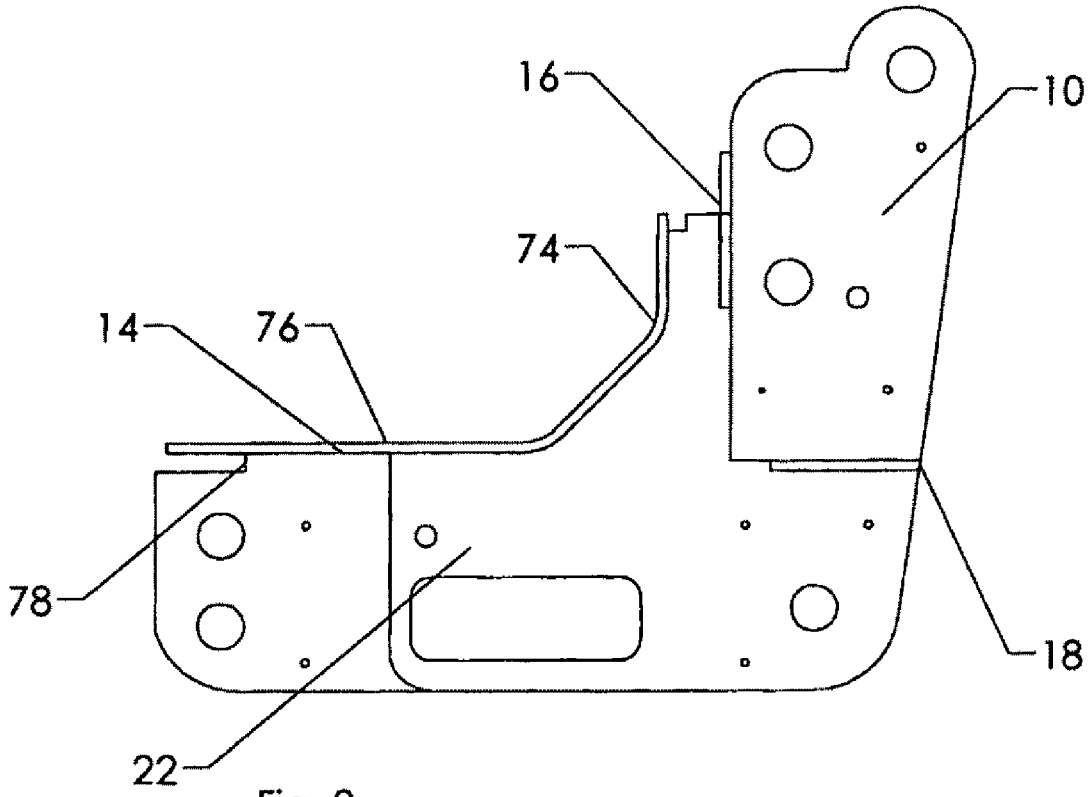
Fig. 8

Fig. 9a
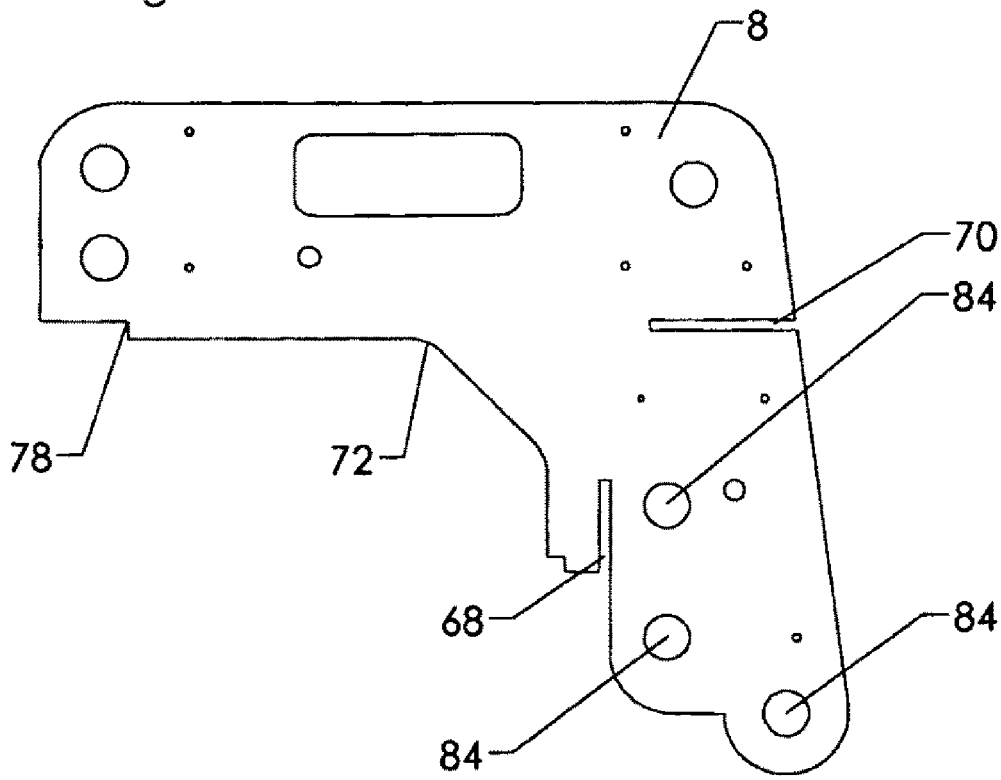
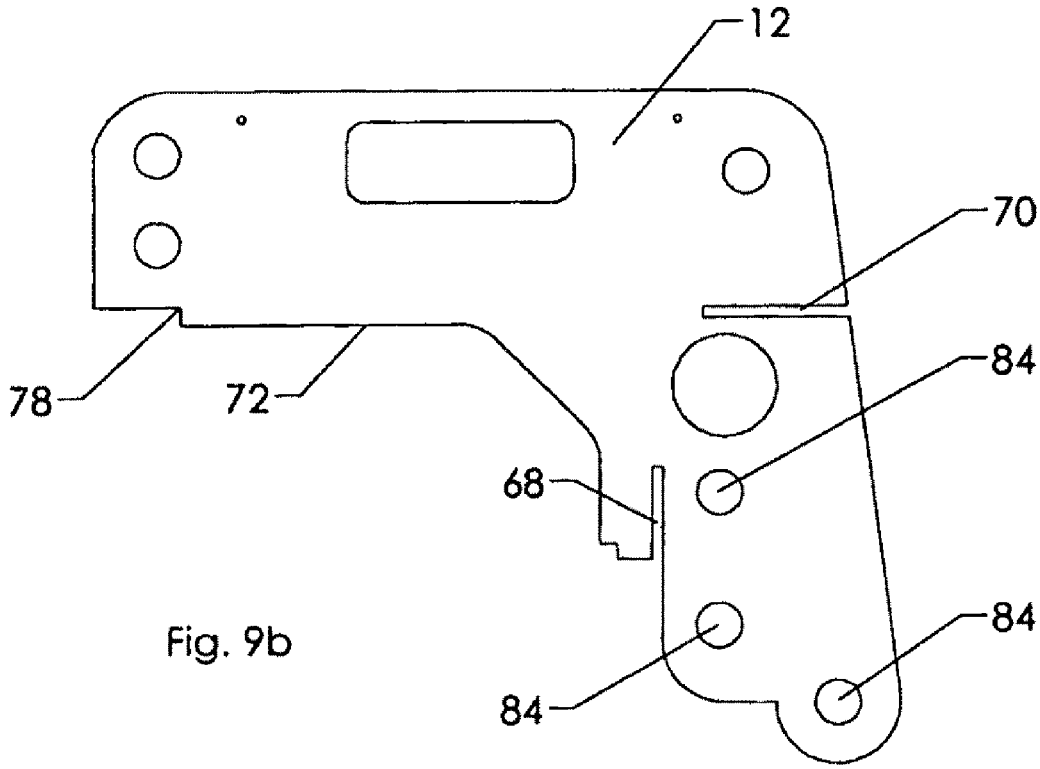
Fig. 9b

Fig. 19a
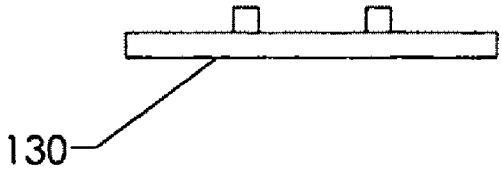
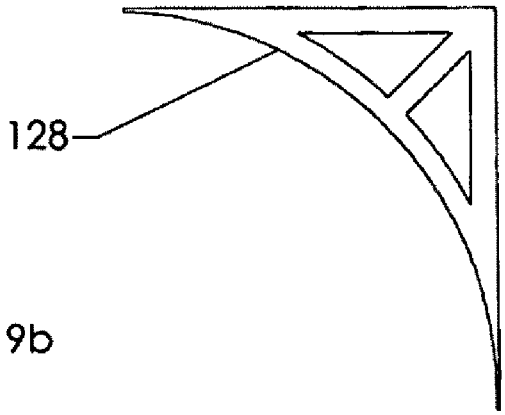
Fig. 19b
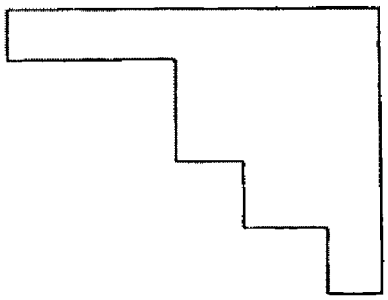
Fig. 19c
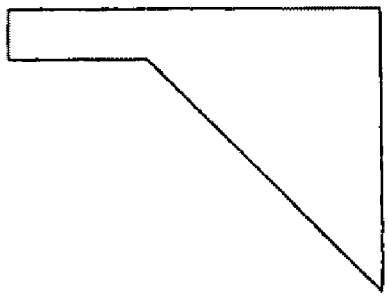
Fig. 19d

FORMWORK AND METHOD FOR CONSTRUCTING RAMMED EARTH WALLS

TECHNICAL FIELD OF THE INVENTION

This invention relates to a formwork system for construction of rammed earth walls to provide a rammed earth wall segment. The invention also relates to a method of using the formwork in rammed earth construction.

BACKGROUND OF THE INVENTION

Rammed earth buildings are durable, strong, and visually attractive and have excellent acoustic properties. Constructing rammed earth structures involves pounding or ramming successive layers of a stabilized earth mixture into a cavity formed by a removable formwork.

However, the formwork systems presently in use can be awkward and bulky to handle, making the construction of a building a slow, labour-intensive process. It is desirable that the formwork be lightweight and easy to assemble, to disassemble and to maneuver, so that each section of the wall may be completed as quickly as possible, subject to the time taken for the ramming process.

Due to the intense forces created during the ramming process, it is also necessary that the formwork be as strong and stable as possible while still minimizing weight. To minimize the number of pieces necessary on each building site, it is preferable that each piece of the formwork be adaptable, and useful for more than one purpose, such as building several different corner shapes. In addition, it is preferable that the builders be able to access various portions of the formwork, such as the top of the cavity, to ensure the earth is being properly packed, particularly once the wall has risen above eye level.

Australian Patent No. 545,322 (the "'322 patent") discloses a pair of spaced side panels, one solid and one portioned into sections. The panels are assembled edge to edge and are secured by suitable connecting means, which comprise tie members or a tightenable bolt assembly across the cavity between the side panels. The side panels may be supported by external brace members and, in one embodiment, by external walers mounted on the side panels or on brackets fitted on the outer side of the panels. The walers may be tightened with a bolt assembly. In use, a back side panel is assembled between two U-shaped end stops, opposed to a lower front side panel. Earth is added and rammed until the level of the earth is just below the height of the front side panel. Another front panel is set on top of the first, and earth is again packed into the cavity. The process continues until the wall is the desired height. However, the end stops of the '322 patent are simply shaped solid columns and do not appear to be adjustable. Nor do they appear to perform any other function, such as supporting the walers or providing handholds for climbing.

Regarding the strength of the formwork, the '322 patent discloses one embodiment in which there are supporting members across the cavity between the side panels, but those members are external to the cavity (i.e. outside the end stops), in order to avoid leaving through-holes in the rammed earth wall. Through-holes are generally to be avoided, since they must be plugged once the wall is complete, and because internal through-rods make it difficult to accurately position insulation within the formwork cavity. However, the external side supports disclosed in the '322 patent may pose difficulties when two connecting wall sections are being constructed. The external supports may also make it difficult to create a chamfer at an end of a wall segment, resulting in less light penetration into the structure created by the thick earth wall. Further, the '322 patent discloses a working platform associated with the side panels, and illustrates it as being quite far above the ground (see FIG. 3), but does not indicate any handholds or other means to reach the platform, on the side panels or anywhere else on the formwork.

Australian Patent No. 561,883 and Canadian Patent Application No. 2,012,959 each disclose a formwork and method for forming a rammed earth wall that is similar to the '322 patent. These patents disclose a different, more complex form of side panel, and various methods to form curves, corners and junctions in the walls. Again, neither of these patents discloses more than a simple, solid, non-adjustable end stop. In particular, Canadian Patent Application No. 2,012,959 discloses waler support shelves mounted on the side panels, but not on the end stops. The Canadian application also discloses an A-shaped external bracing structure with an adjustable means which is intended to both prop up and level the wall.

U.S. Pat. No. 2,400,852 discloses a formwork for rammed earth walls comprising side panels and pivoting posts. The main function of the invention appears to be formwork which can easily be collapsed for transport. However, the side panels and a shelf to hold a spirit level, which comprises integral leveling means, in addition to the overhead beams, are still bulky and may be awkward to transport.

While rammed earth walls tend to be very heavy and strong, internal support structures such as vertical posts may also be used to reinforce and support the wall. U.S. Pat. No. 6,718,722 (the "'722 patent") discloses a method of wall formation which involves spraying an adobe or similar composition on an internal support structure. The '722 patent discloses a cavity, defined by a pair of walls created when frame sheets are erected outside a pair of opposed rows of posts, which may be driven into the ground or set in concrete. The cavity is filled with insulating material.

U.S. Pat. No. 6,263,628 also describes a formwork system including the need for posts in holes in the foundation. However, neither this nor the '722 patent refers to any type of apparatus for simplifying the drilling of uniformly spaced holes in the footing of a wall. The '722 patent refers to "driving" posts into the underlying soil, such as in the embodiment in FIG. 6, which is described at col. 6, line 58. The '628 patent refers to drilling a hole in the foundation on each side of a panel.

U.S. Pat. Nos. 4,768,324 and 4,702,053 describe a wall system comprising upwardly extending pins in the foundation, which are eventually encased in concrete (of which the wall is formed) to securely position the wall on the foundation. According to FIG. 4 of each patent, pins 72 appear regularly spaced in the foundation. However, no detail is provided as to how the pins are inserted into the foundation.

Rammed earth structures have a high thermal mass, so they absorb and moderate heat. However, the corollary to this is that rammed earth structures have poor thermal insulating qualities, as the walls will release the stored heat as the ambient temperature drops. For this reason, it is preferable to add a layer of insulation to each wall to stop the heat from easily passing through. While insulation may be added through linings applied to the wall's exterior surfaces, it is preferable to have the insulation within the thickness of each wall. This allows the building to reap the benefits of the insulation while retaining the appearance, low maintenance, acoustic properties and other benefits of the massive rammed earth walls.

New Zealand Patent No. 236,182 discloses a formwork and method for producing a rammed earth wall including an insulation cavity, which may be filled with air, expanded foam polystyrene or any other solid insulation material. The method of producing the cavity, such that it may be filled with insulating material after ramming, is relatively complicated.

U.S. Pat. Nos. 4,768,324 and 4,702,053 disclose formwork to create insulated concrete walls. Pairs of horizontal ladders locked into position with lock pins hold the insulated core in an upright position. Overall, the structure seems complex and difficult to construct, with several sets of ladders and bars that must be interlocked.

It can therefore be seen that one disadvantage of prior art formwork systems is that the systems are overall very bulky and difficult to transport. The end stops and sidewalls of these systems tend to be of limited adaptability. Several different pieces would therefore be required to create different wall shapes and configurations and each piece must be transported out to the construction site.

While lightweight formwork systems are preferable, it is also necessary to provide enough lateral support to the formwork to prevent bulges in the earth walls. While connectors through the bulk of the wall are well-known, such through connectors may leave unsightly holes in the wall once the formwork is removed. These holes must then be plugged individually, which is time consuming and difficult to accomplish without interfering with the thermal envelope of the wall.

In addition, the prior art formwork systems generally include end stops which are solid pieces, inserted between the sidewalls. The systems are therefore launched off their sidewalls, again limiting the adaptability of the basic formwork, requiring the use of variant pieces to create different wall shapes and curvatures. This increases the number of formwork pieces necessary to create various wall shapes.

Further, the prior art generally requires additional support structures to allow the builder to access various portions of the wall during construction.

Finally, when internal support structures (such as posts in the bed beneath the wall) are used, it can be difficult to properly space and position such structures. Such spacing is preferable, in order to provide uniform support to the wall and minimize stresses. It is therefore preferable to provide a means to quickly and accurately position internal structures, to provide the proper support without slowing down the construction process.

It is therefore an object of the present invention to provide an improved formwork system that overcomes the foregoing deficiencies. In particular, it is an object of the invention to provide a formwork system with one or more of the following features:

(a) accommodates and secures a central plane of insulation in a rammed earth wall;
(b) has no through ties to hold the side panels together;
(c) is launched off its end panels, with side panels between end panels;
(d) has integral handholds for climbing;
(e) is easily adjustable for different wall thicknesses and lengths;
(f) enables varying radii of walls;
(g) creates a soft-cornered but hefty visual appeal;
(h) is stackable, to create walls of indefinite height;
(i) has sectional end panels connected with a hinge type assembly, which are easily modified to create a 90° corner, a 45° corner and a column;
(j) contains an integral plumb bob;
(k) creates lintel-ready walls, if desired; and
(l) creates integral window and door bucks, if desired.

Other objects of the present invention will be appreciated by reference to the detailed description of the invention that follows.

SUMMARY OF THE INVENTION

The invention provides a formwork system for use with constructing walls of rammed earth. The summary herein provides a general overview of the invention and is not intended to define essential features of any specific aspect of the invention.

The formwork is a modular system comprised of one or more end panels, which may be combined in various configurations to provide an end stop of adjustable width, which will produce walls of various thicknesses. The end stop may be used with side panels of varying lengths to enable construction of rammed earth walls of varying lengths, with an insulating core.

Two identical, invertable L-shaped end panels are combined to form a U-shaped end stop to contain and form each end of a wall section. Each L-shaped end panel is constructed of an elongated vertical main frame, an interior frame and a support frame. There is preferably a chamfered portion within the frame to bevel the ends of the wall segment. An elongated key piece may be used to hide the seam at the edge of the side panels, or to provide a particular configuration to the end face of the wall segment.

The frame pieces are releasably locked together with top and bottom shelves at either end. The support frame may comprise handholds to assist a person in climbing the end panel. Middle shelves may be spaced along the length of the end panel, providing support for the panel and places for installing pins to hold two end panels together, thereby forming an end stop. Leveling plates may be used at the top and/or bottom of the assembled end panels to ensure the wall will be plumbed properly, while external braces may further support the wall. An internal frame inside the length of the end panel holds an insulating core during wall construction.

In another embodiment, the end panels are relatively flat, rather than L-shaped, and thus produce a flat, compact end stop for wall construction.

In one aspect, the invention comprises a lockable, approximately L-shaped end panel with cooperating frame pieces and adjustable shelves for use with rammed earth construction.

In another aspect, the invention comprises a formwork system of cooperating adjustable U-shaped end stops, for use with rammed earth construction.

In yet another aspect, the invention comprises a formwork system of cooperating adjustable U-shaped end stops with one or more internal frames to secure a central insulating core, for use with rammed earth construction.

In yet another aspect, the invention comprises a formwork system of cooperating adjustable U-shaped end stops with integral handholds to facilitate access to the upper portions of the formwork.

In another aspect, the invention comprises a method of using the formwork to construct a portion of a rammed earth structure, comprising the steps of constructing two end stops by assembling two or more end panels and ramming earth into the cavity created by the end stops.

In a further aspect, the invention comprises a method of using the formwork to construct a portion of a rammed earth building or other structure, comprising the steps of constructing two end stops by assembling two or more end panels, inserting two side panels and ramming earth into the cavity created by the end stops and side panels.

In yet a further aspect, the invention comprises a method of using the formwork to construct a portion of a rammed earth building, comprising the steps of constructing two end stops by assembling two or more end panels, inserting two side panels and a formwork piece and ramming earth into the cavity created by the end stops and side panels, leaving a void in the rammed earth where the formwork piece is located.

These and further aspects of the invention will be appreciated by reference to the detailed description of the preferred embodiment and are defined by the claims that follow.

BRIEF DESCRIPTION OF THE DRAWINGS

The invention will now be described with reference to the following drawings, in which:

FIG. 7 is a top view of the end panel of FIG. 1;

FIG. 8 is a bottom view of the end panel of FIG. 1;

FIG. 9*a* is a top view of a top or bottom shelf of an end panel according to a first embodiment of the invention;

FIG. 9*b* is a top view of a middle shelf of an end panel according to a first embodiment of the invention;

FIGS. 19*a*-19*d* are top views of alternate corner shaping pieces according to the third embodiment of the invention;

DETAILED DESCRIPTION OF THE PREFERRED EMBODIMENTS OF THE INVENTION

Figure 1A:
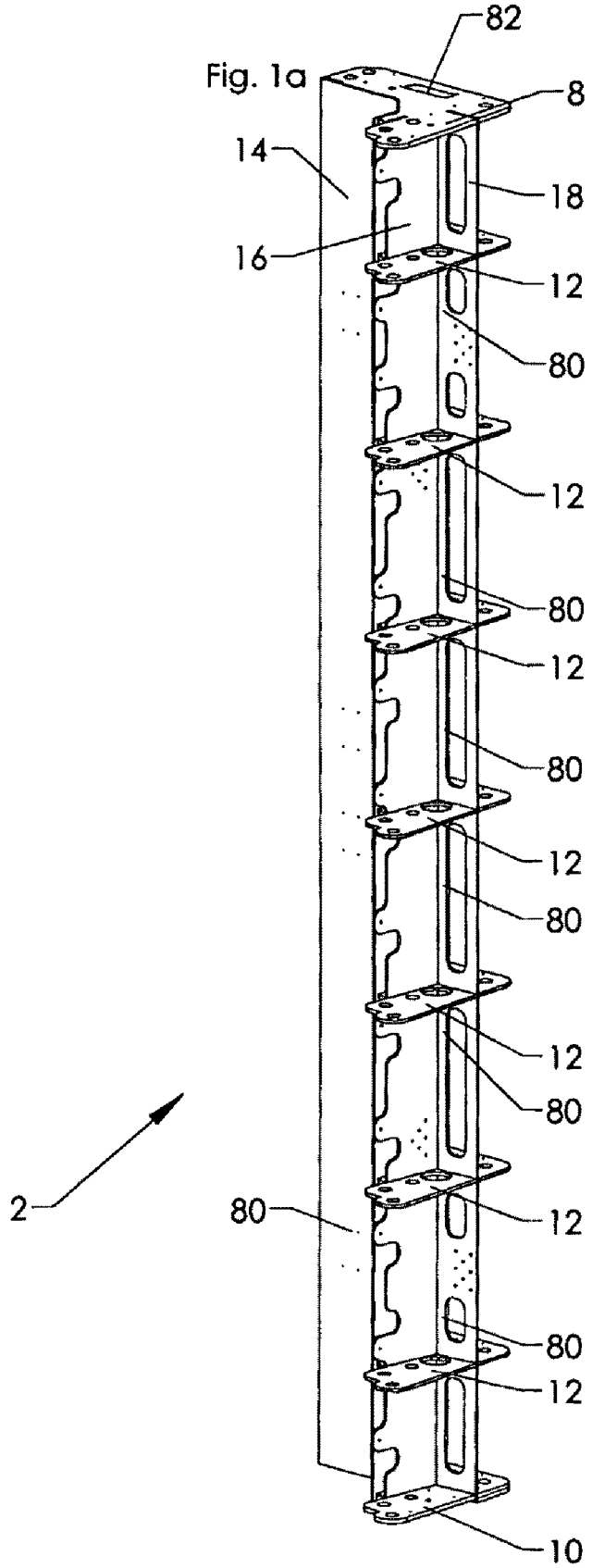
FIG. 1*a* is a perspective view of an end panel according to a first embodiment of the invention.
Figure 1B:
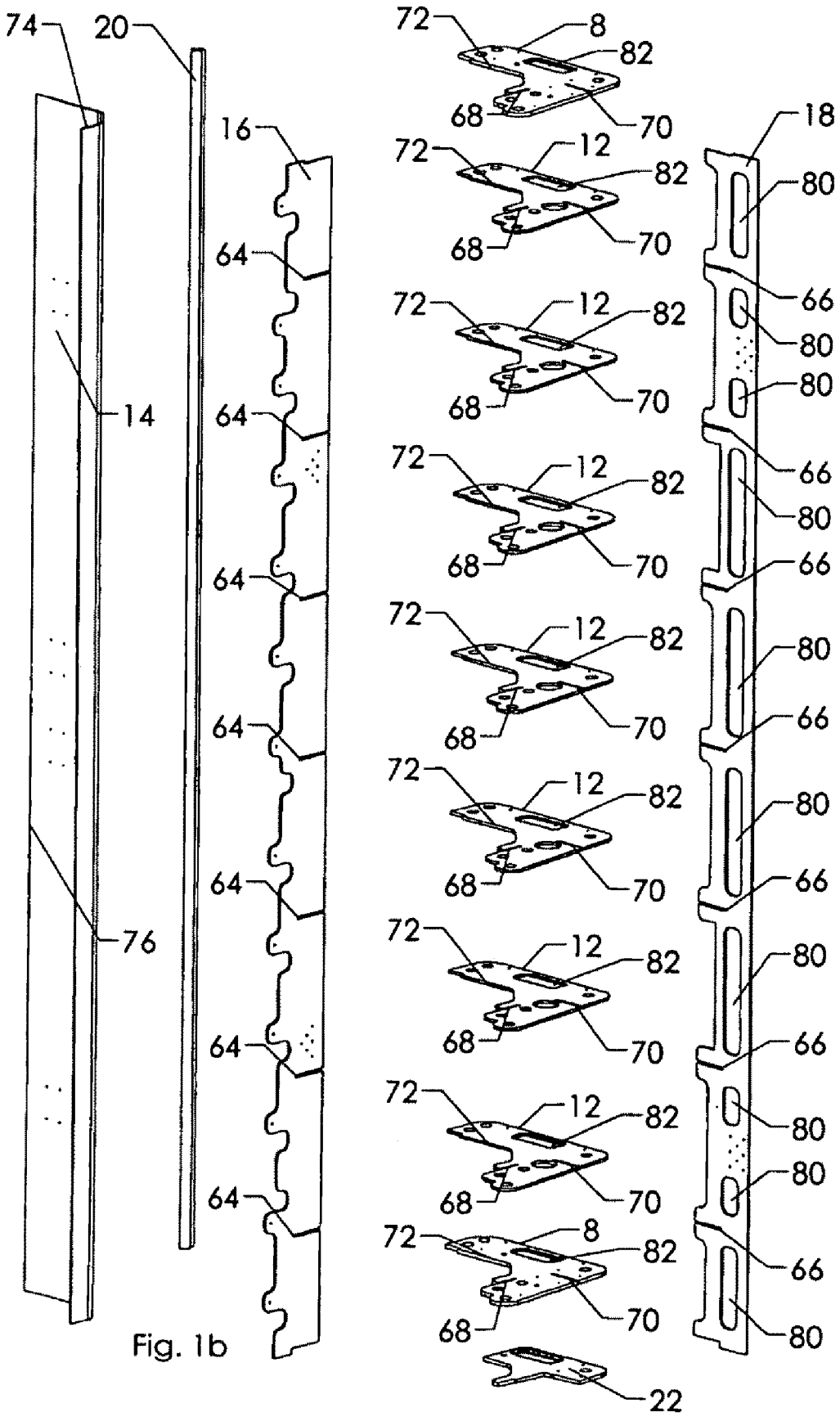
FIG. 1*b* is an exploded view of the end panel of FIG. 1*a;*
Figure 3A:
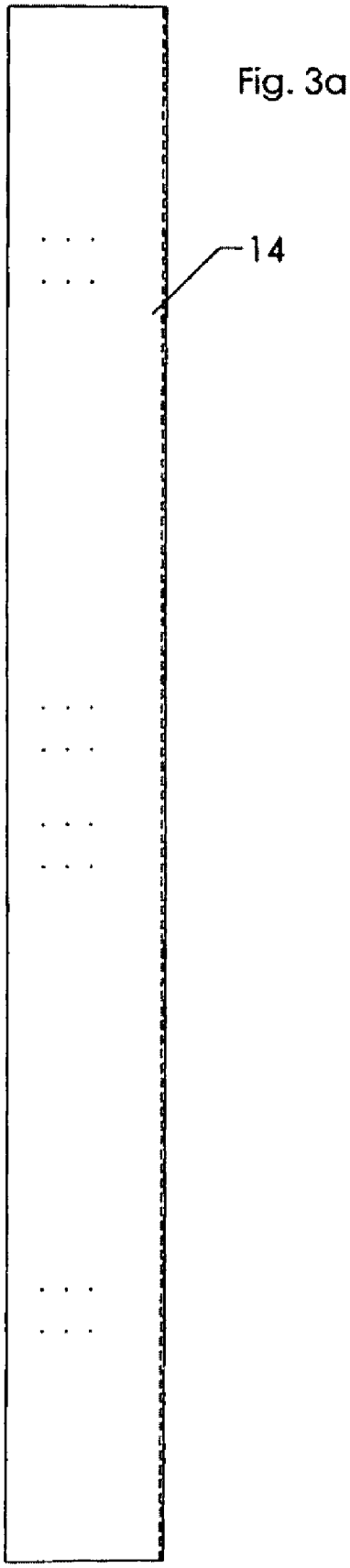
FIGS. 3*a* and 3*b* are side and top views, respectively, of a main frame of an end panel according to a first embodiment of the invention.
Figure 4:
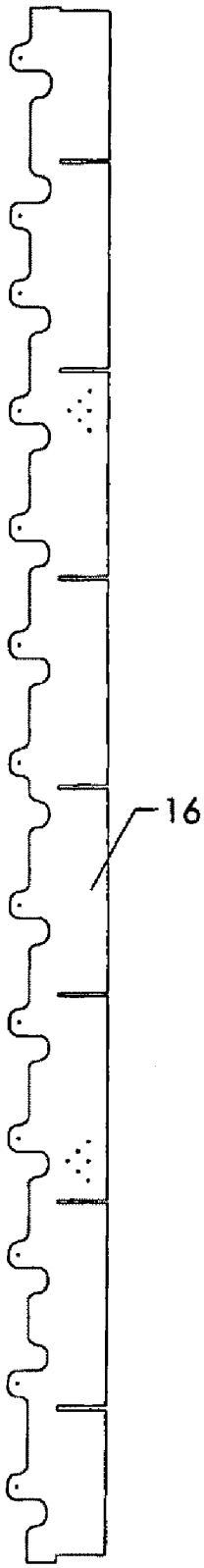
FIG. 4 is a side view of the interior frame of an end panel according to a first embodiment of the invention.
Figure 5:
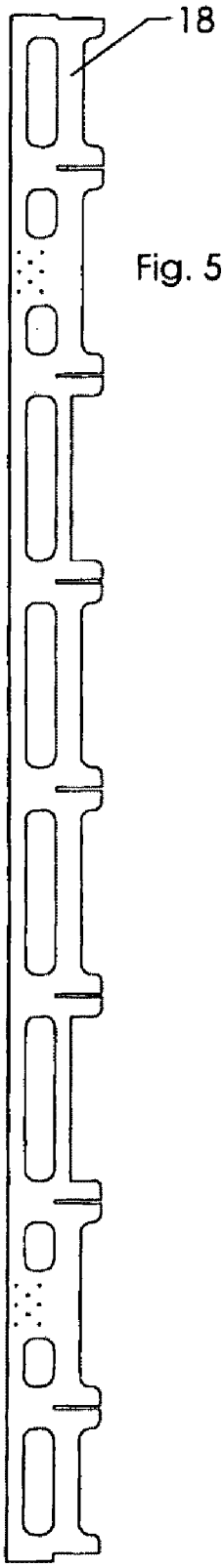
FIG. 5 is a side view of the handle frame of an end panel according to a first embodiment of the invention.

FIGS. 1*a* and 1*b* illustrate perspective and exploded views of a first embodiment of an end panel 2 in accordance with an embodiment of the present invention. End panel 2, comprises an elongated main frame 14 (FIGS. 3*a* and 3*b*), an interior frame 16 (FIG. 4), a handle frame 18 (FIG. 5) and outer shelves 8 (FIG. 9*a*) at the top and bottom of the formwork. Middle shelves 12 (FIG. 9*b*) may also be used to increase the strength of the formwork.

Figure 3B:
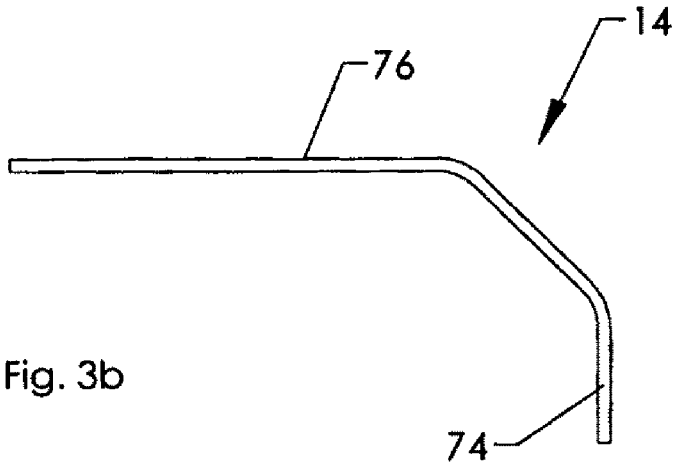

As more clearly illustrated in FIG. 3*b*, main frame 14 has a curved, approximately L-shaped cross-section with a short leg 74 and a long leg 76, but may comprise other than a 90-degree angle. A wall segment created using the main frame 14 with an angle as shown in FIG. 3*b* will have corners that are slightly curved rather than squared-off, creating a softer look. The angle can be varied to produce different corner shapes from a 90° angle to almost any other shape.

Referring to FIGS. 1*a* and 1*b*, interior frame 16 is placed along the short leg 74 of the main frame 14 and is secured to shelves 8, 12 by cooperating slots 64 (in the interior frame) and slots 68 (in the shelves 8, 12). Handle frame 18 runs approximately perpendicular to the straight edge of interior frame 16, and approximately parallel to the long leg 76 of the main frame 14 and is secured to shelves 8, 12 by cooperating slots 66 (in the handle frame) and slots 70 (in the shelves 8, 12). However, it is contemplated that shelves 8, 12 may be formed integrally with one of the other frame pieces, which simplifies the assembly process.

Outer shelves 8 include those located at the top and bottom of the end panel 2. Middle shelves 12 (FIG. 9*b*) are generally similar to the outer shelves, but may be thinner to reduce the overall weight of the formwork pieces and of the assembled formwork. If the shelves comprise separate pieces which are to interlock with the frame, slots 64 in interior frame 16 interlock with slots 68 in each shelf, while slots 66 in handle frame 18 interlock with a second set of slots 70 in each shelf. Inner curve 72 of each shelf engages with legs 74, 76 of main frame 14. The engagement of the pieces in this manner produces a sturdy L-shaped end panel 2. Any number of middle shelves 12 may be used, but the middle shelves 12 are preferably evenly spaced between outer shelves 8, to provide uniform strength to the end panel 2. The weight of the end panel 2 of course decreases as the number of additional middle shelves 12 decreases.

Access to the full height of the assembled end panel 2 is provided by handholds 80 at spaced intervals in the handle frame 18, and by handholds 82 in the shelves 8, 12. Shelves 8, 12 may also be supported with an elongated vertical member, such as a square pipe, which will strengthen and support the assembled end panel 2 and may allow for the use of fewer shelves for the same structural strength.

Figure 10:
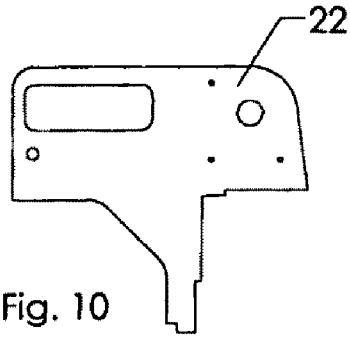
FIG. 10 is a top view of a leveling plate of an end panel according to a first embodiment of the invention.

If required, leveling plate 22 (best shown in FIG. 10) may be positioned on the bottom of end panel 2, as shown in FIG. 1*b*. Leveling plate 22 may be used to ensure the assembled end panel 2 is plumb.

Figure 6A:
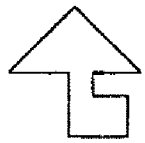
FIGS. 6*a*-6*c* are sectional views of elongated key strips of various configurations according to a first embodiment of the invention.
Figure 6B:
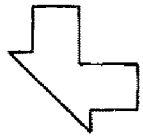
Figure 6C:
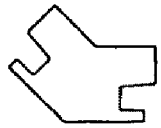

Referring again to FIG. 1*b*, elongated key strip 20 is located towards the end of the long leg 76 of main frame 14, away from the short leg 74. Elongated key strip 20 engages with groove 78, created by abutment of main frame 14 with each of the outer shelves 8 and middle shelves 12. Groove 78 is best shown in FIGS. 7 and 8, in relation to outer shelves 8. As shown in FIGS. 6*a*-6*c*, elongated key strip 20 may have different cross-sections. Each cross section will produce a slightly differently shaped groove in a finished wall segment, as will be discussed later.

Figure 2:
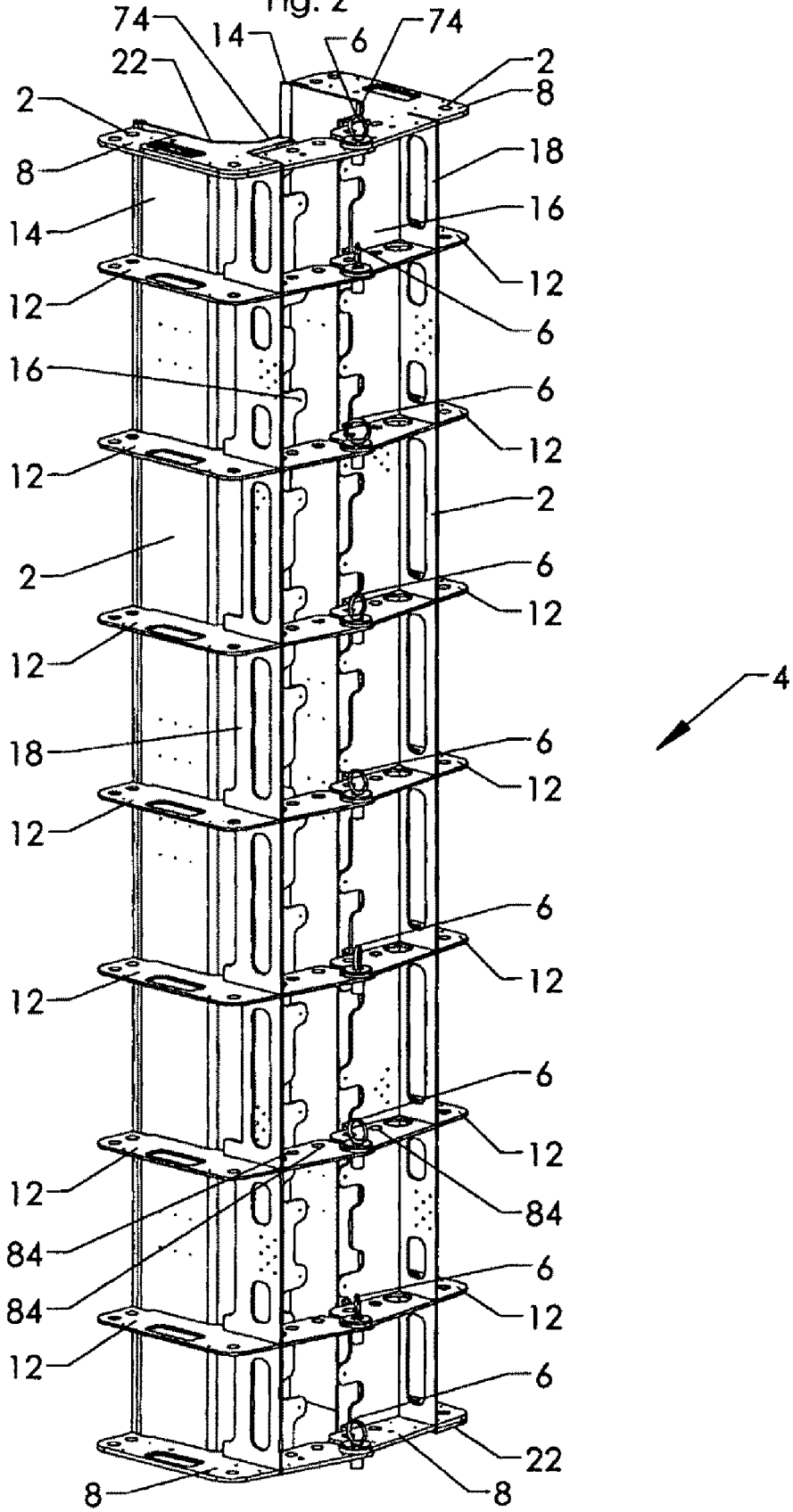
FIG. 2 is a perspective view of an end stop according to a first embodiment of the invention.

FIG. 2 illustrates two end panels 2 that have been combined into a single end stop 4 by connection of the short legs 74 of each end panel 2. Suitable connecting means, such as one or more hitch pins 6, ensure that the short legs 74 of each end panel 2 meet and lock together properly. Extra strength may be assured by connecting the end panels 2 together at several points along the length of the end panels 2, such as with a hitch pin 6 at each of the outer and middle shelves 8, 12 as shown or by running a full height pipe (not shown) through holes in the shelves to connect the end panels 2. Connecting means such as hitch pins 6 are preferable because they allow the two end panels 2 to rotate with respect to each other, allowing the construction of a variety of wall shapes. Holes 84 (best shown in FIGS. 9*a* and 9*b*) at several positions in shelves 8, 12 provide building flexibility, allowing the end panels 2 to be positioned various distances apart, creating wider or narrower end stops 4, to create walls of varying thicknesses.

FIGS. 11 to 14 illustrate an alternate embodiment of an end panel 2 in accordance with an embodiment of the present invention.

Figure 11:
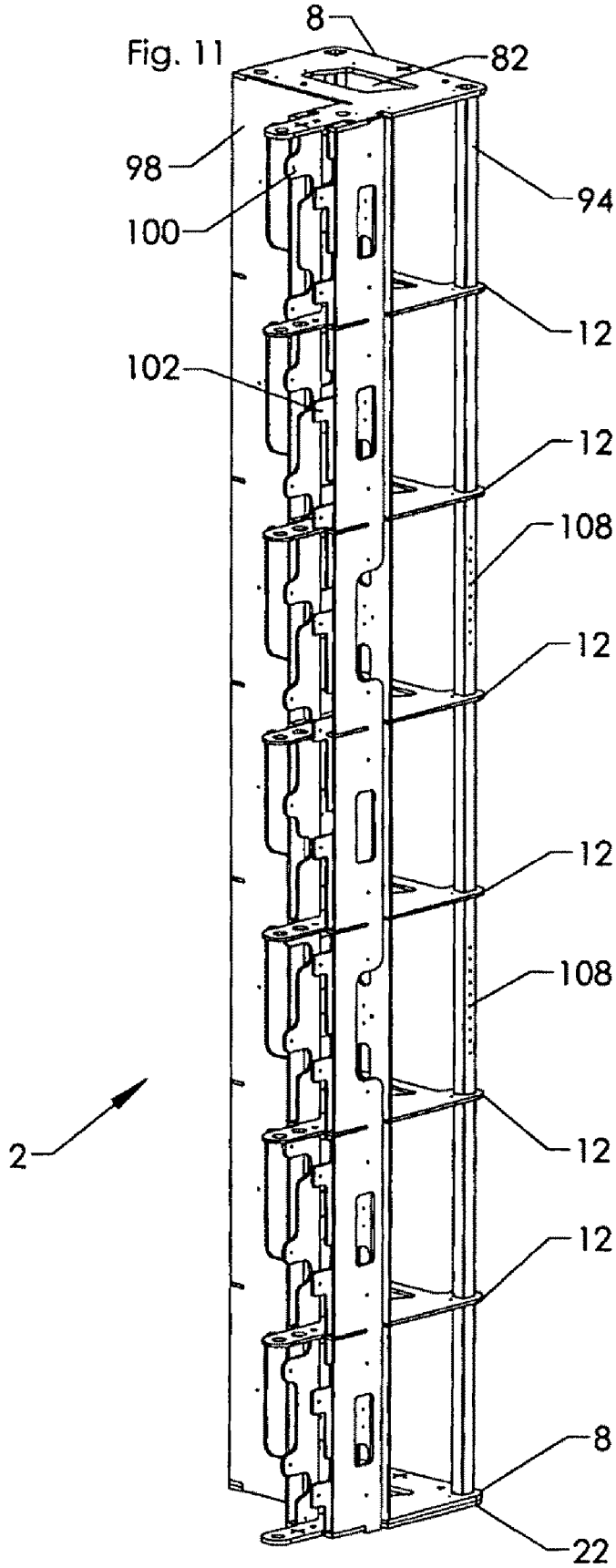
FIG. 11 is a perspective view of an end panel according to a second embodiment of the invention.
Figure 12:
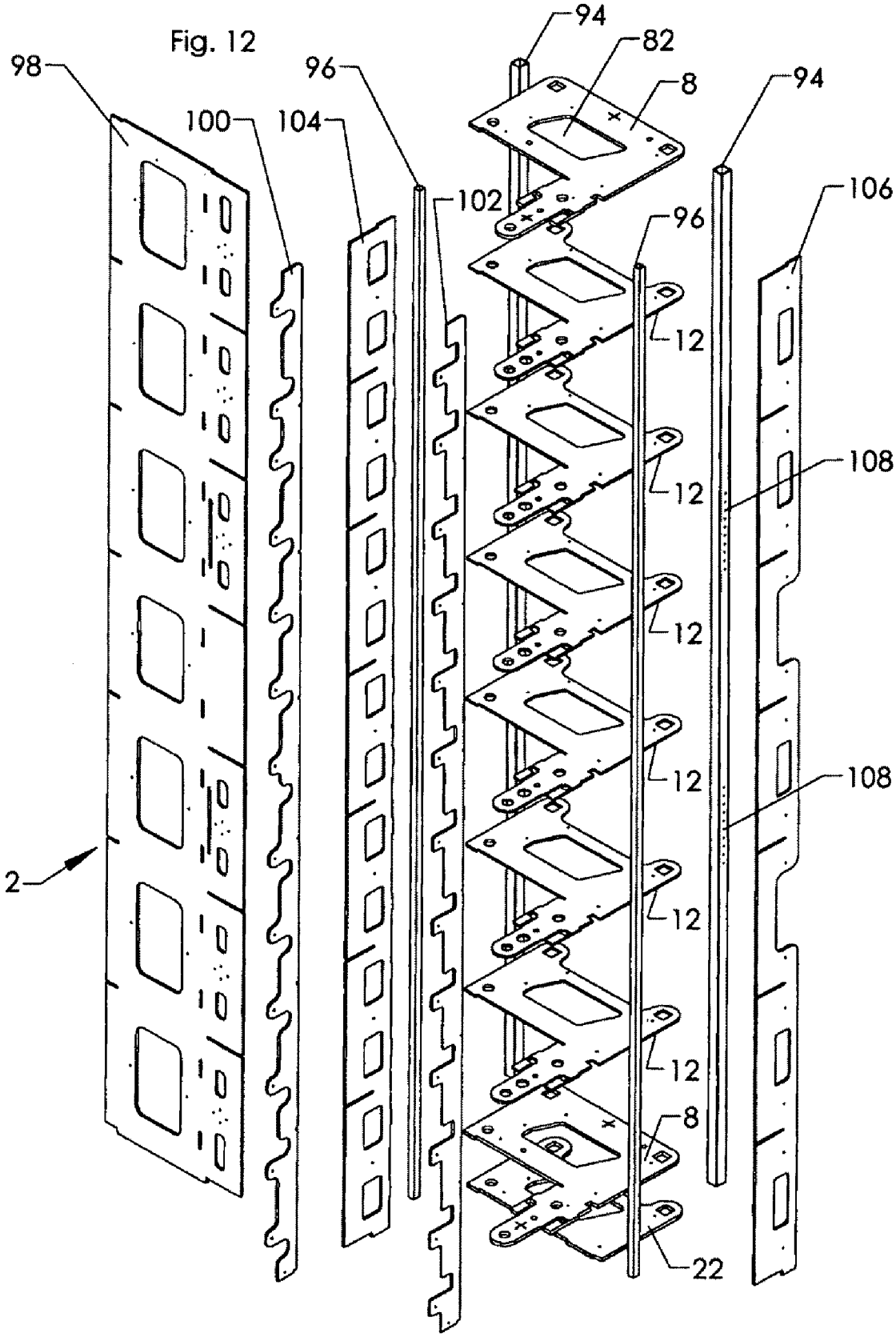
FIG. 12 is an exploded view of an end panel according to the second embodiment of the invention.

In this embodiment, end panel 2 comprises a similar frame structure to that described in the previous embodiment, with somewhat modified shelves 8, 12. As best seen in FIGS. 11 and 12, the internal frame elements comprise a main frame 98, interior frame members 100, 102, support frame 104 and exterior frame 106. All of the internal frame elements are preferably connected and secured by means of slots and tabs in those elements, and are locked together with shelves 8, 12. Further support is provided by inner vertical supports 96. Shelves 8, 12 are still approximately L-shaped and are to be joined along one leg of the L, but are somewhat larger than in the previous embodiment, thereby providing a built-in shelf and handholds. To provide further support for the end panel 2 and for the ends of the walers, one or more vertical support members 94 may also be inserted along the height of the end panel 2. Once walers are inserted on each shelf 8, 12, they may be wedged into place against the side of the end panel, or may be secured by any other appropriate method, such as clamps (not shown). Vertical support members 94 are preferably square pipes, to provide a flat surface against which the walers may be wedged, but can be of any appropriate configuration, particularly if another method is used to secure the walers. Vertical support members 94 may also be provided with holes 108 by which external braces (not shown) may be securely attached to the end panel 2, ensuring that the structure does not lean.

Figure 13:
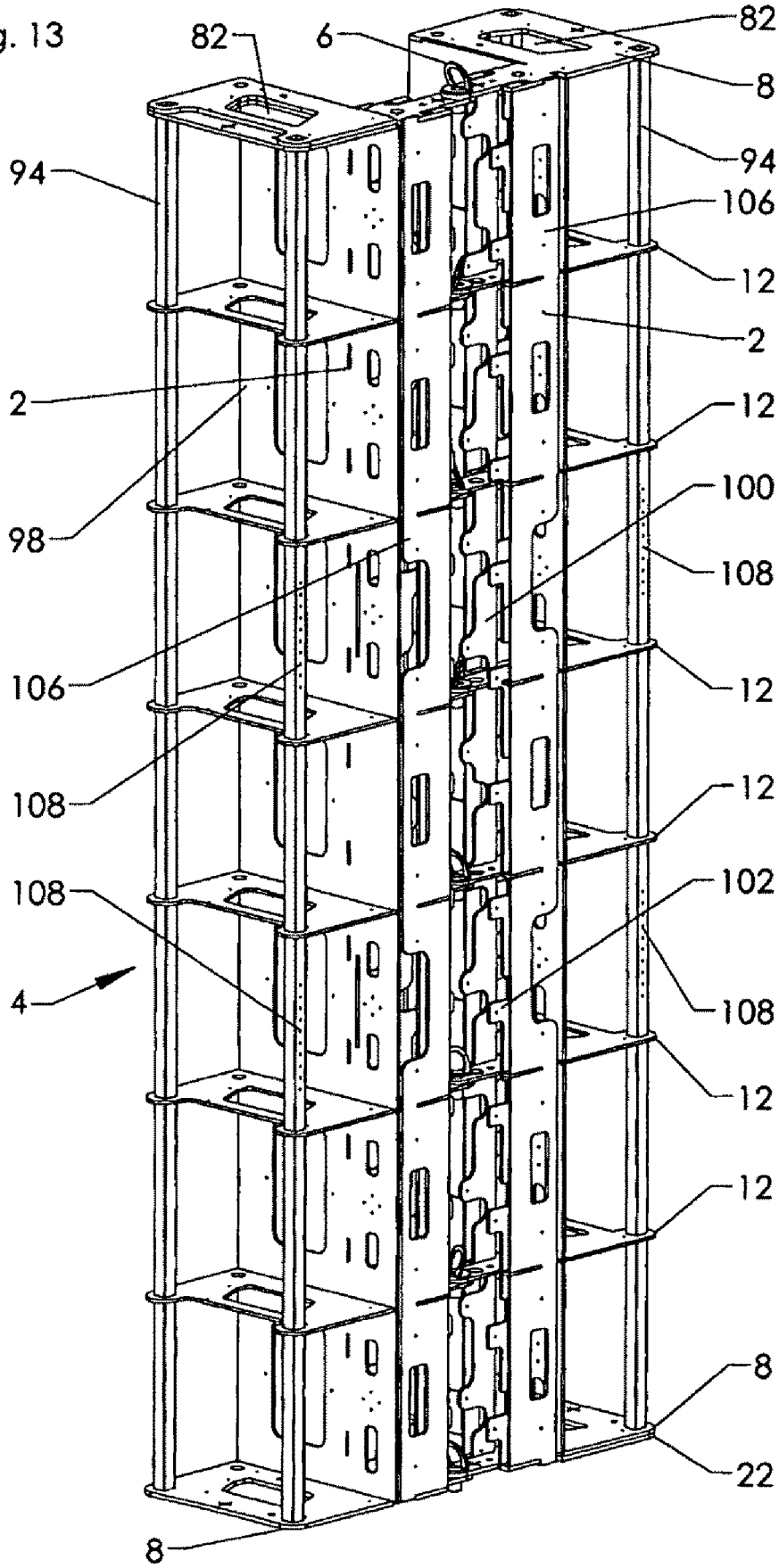
FIG. 13 is a perspective view of an end stop according to the second embodiment of the invention.

FIG. 13 shows an end stop 4, comprising two connected end panels 2.

Figure 14A:
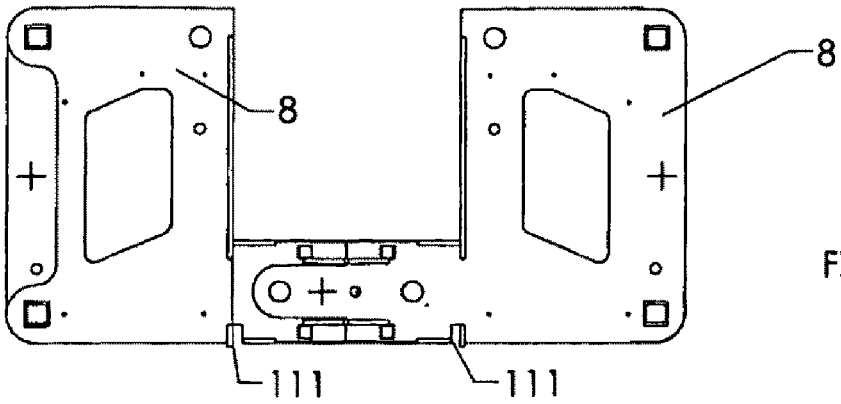
FIGS. 14*a*-14*d* are top views of alternate end stop connection configurations.
Figure 14B:
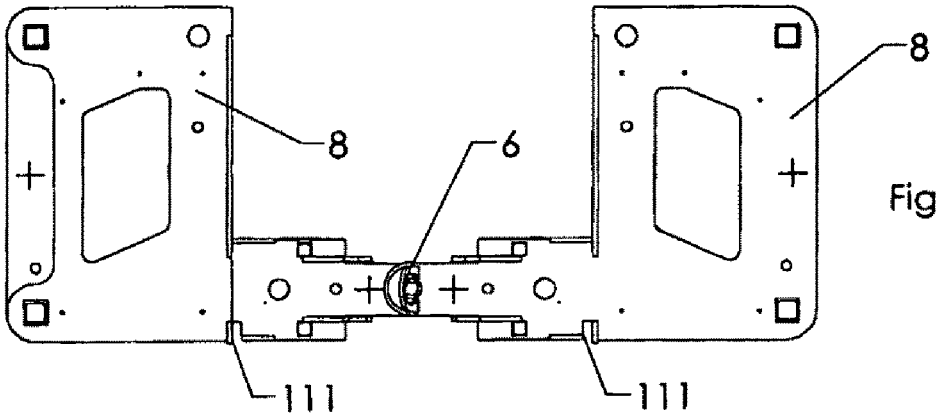
Figure 14C:
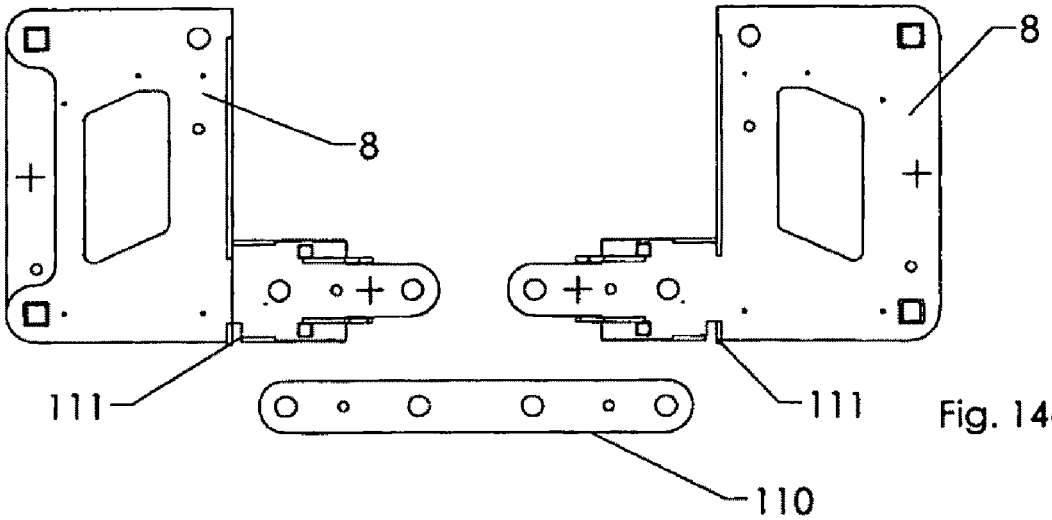
Figure 14D:
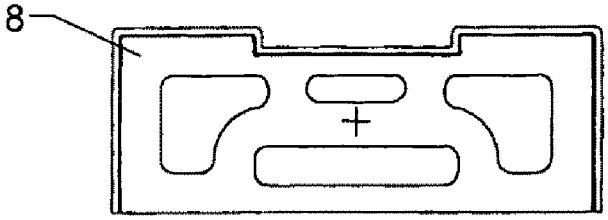

As best shown in FIGS. 14*a*-14*c*, it is contemplated that various wall thicknesses may be achieved by selectively spacing and connecting the shelves. A spacer 110 may be used to create further separation between shelves 8 and 12 (not shown), thereby making it possible to create a thicker wall segment without the need for larger shelves. In addition, it is contemplated that a shelf 8 without a separate hinge element may be used, as shown in FIG. 14*d*. The outside of shelves 8 (that is, the flat side opposed to the side forming the base of the U-shape) further has notches 111 into which side panels (not shown) may be inserted during wall construction, as discussed below. This allows construction of wall segments from both sides of one end panel, thus speeding the rate at which wall segments can be built. This is also a particularly interesting option if the wall segment under construction is relatively short. A wall segment springing off the inner side of the shelves shortens the effective distance between end stops, meaning shorter wall segments may not have enough space for the tamping machinery to properly access the cavity. Forming the wall segment from the outside of shelves 8 will open up the end panel, allowing increased access to the cavity created between two end stops 4 (not shown).

FIGS. 15 to 19 illustrate another alternate embodiment of an end stop 4 in accordance with an embodiment of the present invention.

Figure 15:
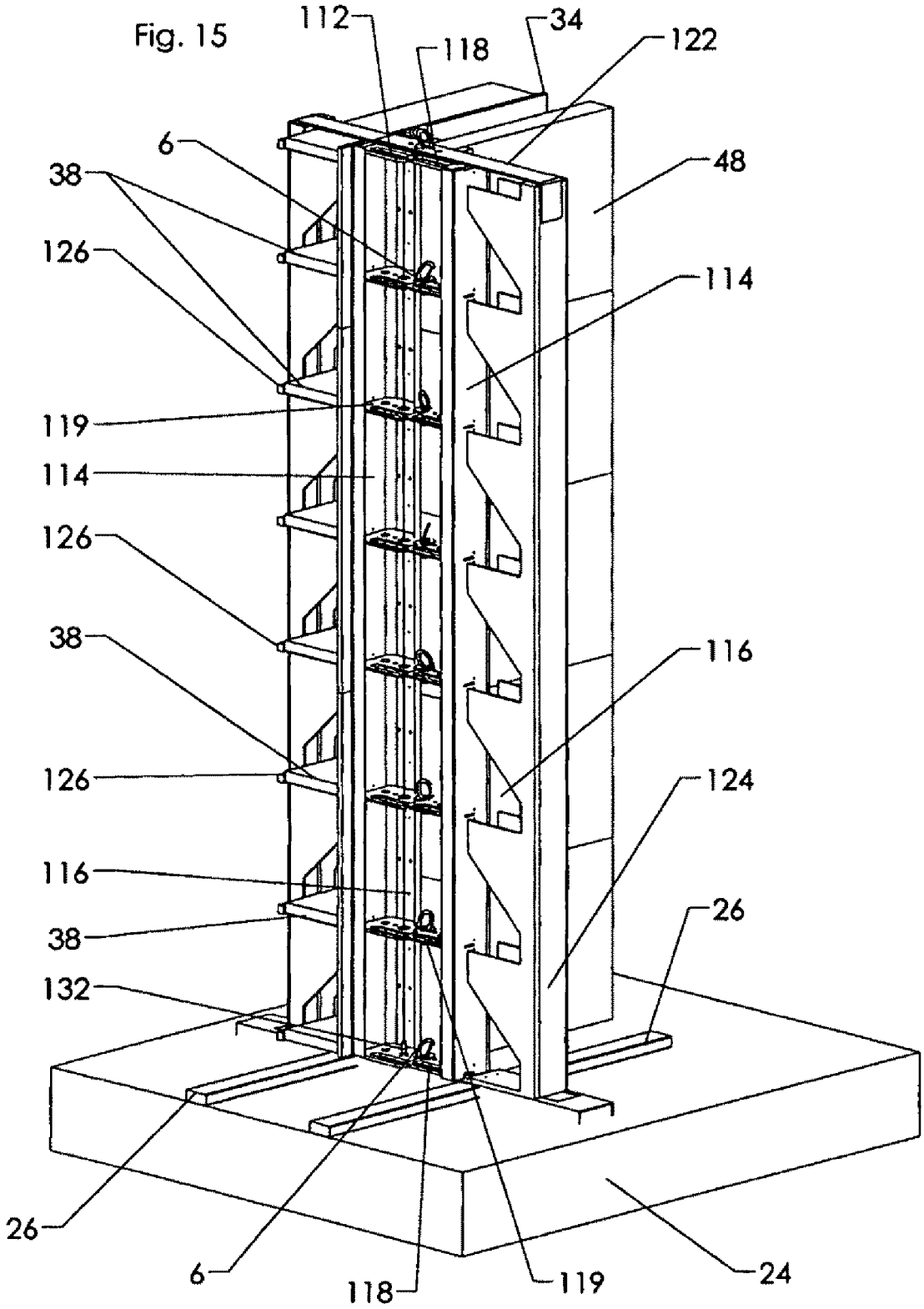
FIG. 15 is a perspective view of an end stop according to a third embodiment of the invention.
Figure 16:
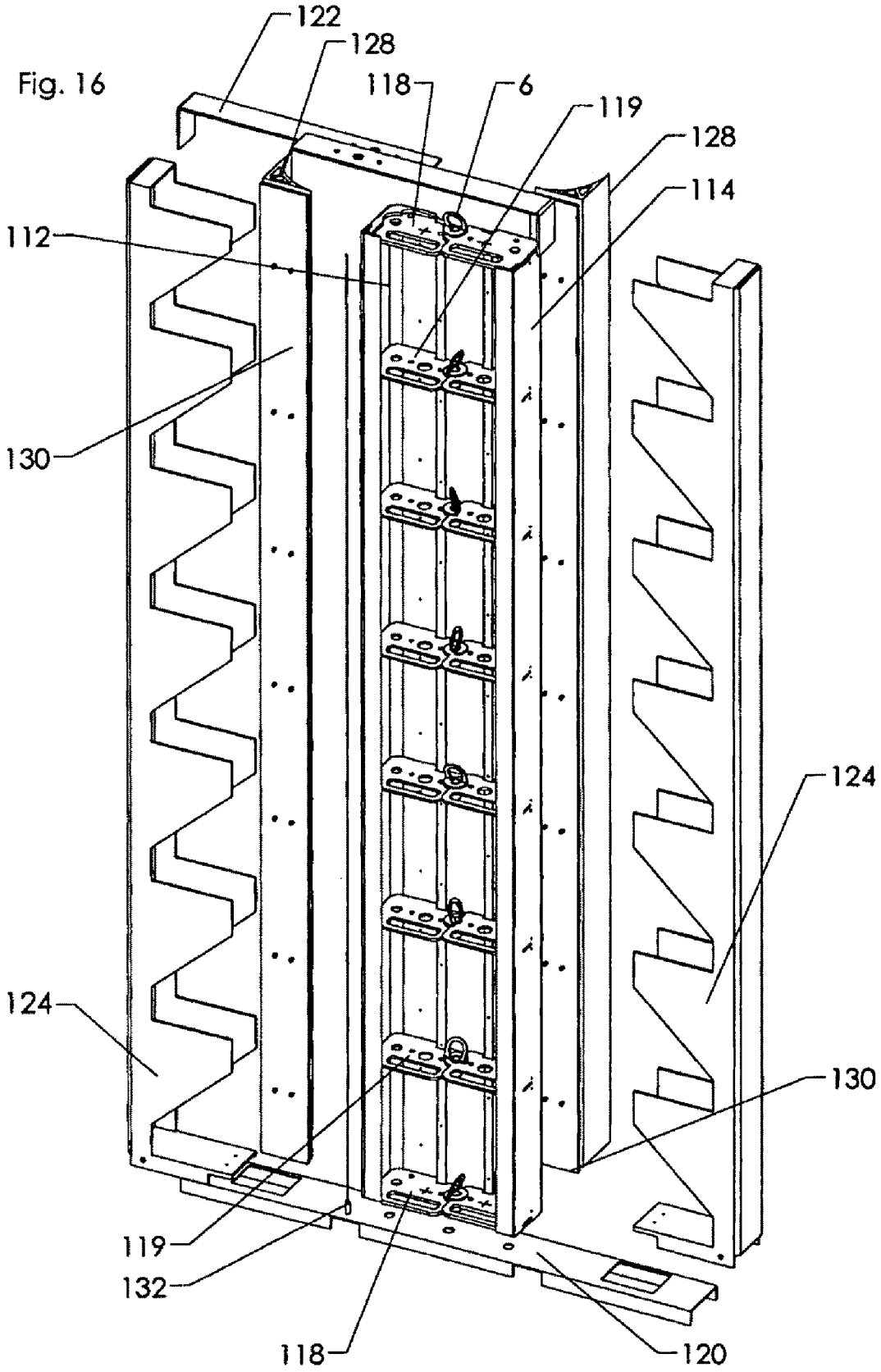
FIG. 16 is an exploded view of an end stop according to the third embodiment of the invention.

In this embodiment, end stop 4 comprises three main frame elements, namely hook frame 112, outer frame 114 and interior frame 116, which interlock and are held in place by horizontal support shelves 118, 119, as best shown in FIGS. 15 and 16. Additional support may be provided by bottom shoe 120 and overhead connector 122. External support members, such as strongbacks 124, may be used to provide lateral support and to provide shelves upon which walers 38 (not shown) will be inserted and secured.

Bottom shoe 120 also serves to locate and support the formwork. Shoe 120 is designed to fit over the longitudinal supports 26 (not shown), which will be discussed further below, and is preferably marked, such as with pre-made holes, to allow the formwork to be accurately placed and securely fastened to the footing upon which the wall segment is constructed.

Figure 17A:
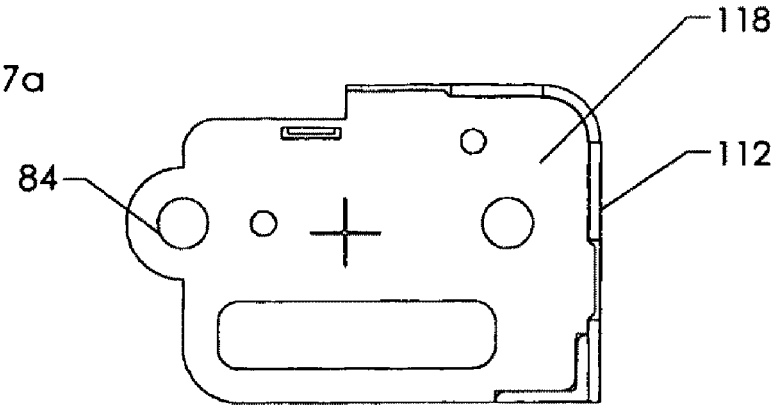
FIGS. 17*a*-17*c* are top views of the shelves of an end stop according to the third embodiment of the invention.
Figure 17B:
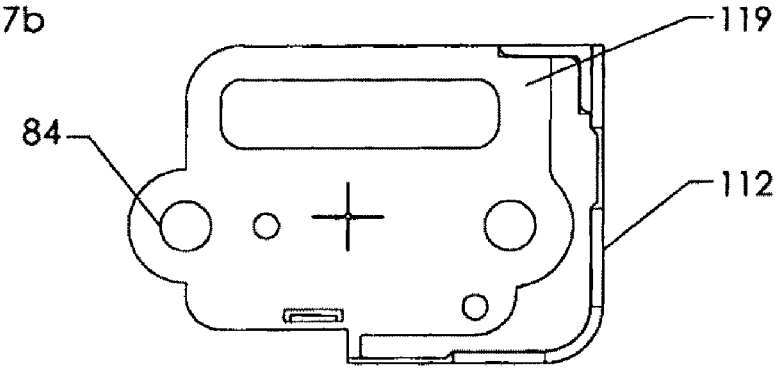
Figure 17C:
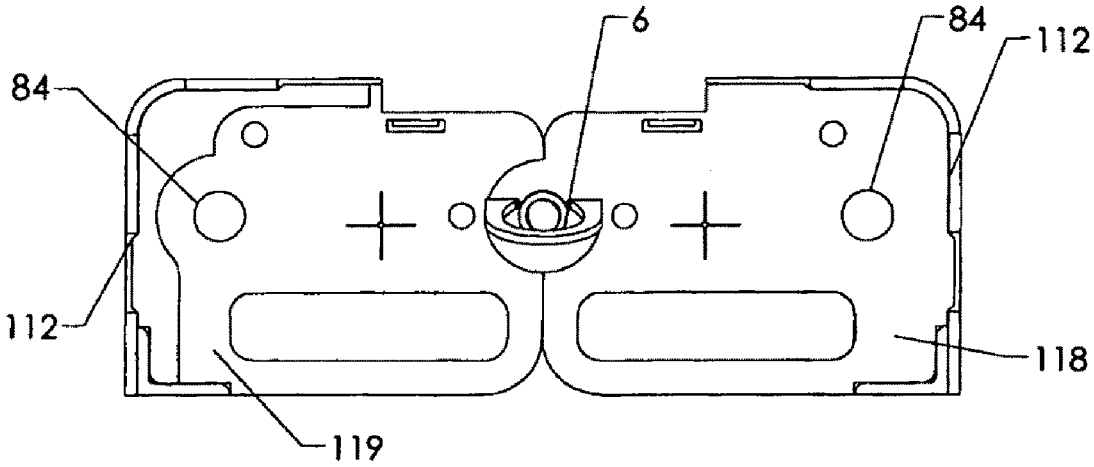

As best seen in FIGS. 17*a*-17*c* horizontal support shelves 118, 119 are preferably secured with a hitch pin 6. FIG. 17*c* shows the interlock between shelf 118 and hook frame 112, as well as the connection between shelf 119 and hook frame 112.

Figure 18:
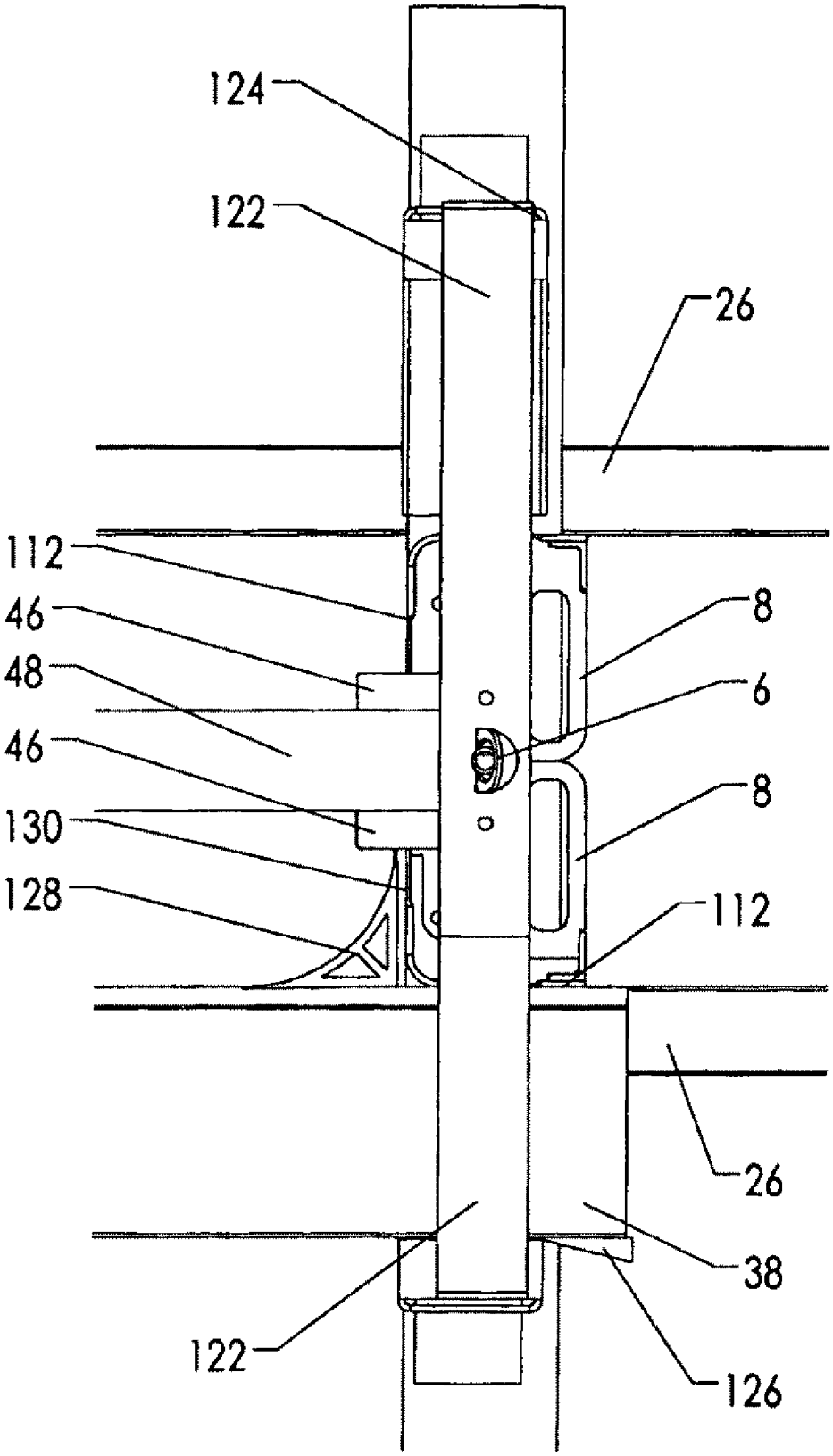
FIG. 18 is an enlarged top view of a portion of an end stop according to the third embodiment of the invention.

As best seen in FIG. 18, the corners of a wall segment constructed with this embodiment of the invention may also be varied. A rounded corner may be formed by the insertion of an elongated corner key piece 128. For maximum flexibility during construction, end panel 4 is preferably constructed with an attachment piece 130, to which key piece 128 can easily be attached and removed. Key piece 128 may be provided in a variety of different shapes, shown in FIGS. 19*b*-19*d*, each of which will provide a different appearance to the corner of a wall segment. A square corner may be created simply by assembling the end panels and inserting the side panels, without inserting key piece 128.

FIG. 18 also shows that back side panel 34 does not abut an inner surface of end stop 4, as in the other described embodiments, but rather extends between hook frame 112 and strongback 124 and may therefore extend beyond the back side of the end stop. The benefit of this arrangement is that any length of back side panel (and front side panel 54, not shown) may be used. Typically, the length of the side panels must match the desired wall segment length. This can limit building flexibility during construction in order to conserve the side panels, it is generally necessary to build all of the longest wall segments first, then successively cut the side panels down to the length of shorter wall segments. However, with this embodiment, any length of side panel may be used to build a (shorter) wall segment, so the wall segments may be built in any order dictated by the working conditions on site.

FIGS. 20-37 illustrate a preferred method of using the formwork as described above to construct a rammed earth wall segment.

Figure 20:
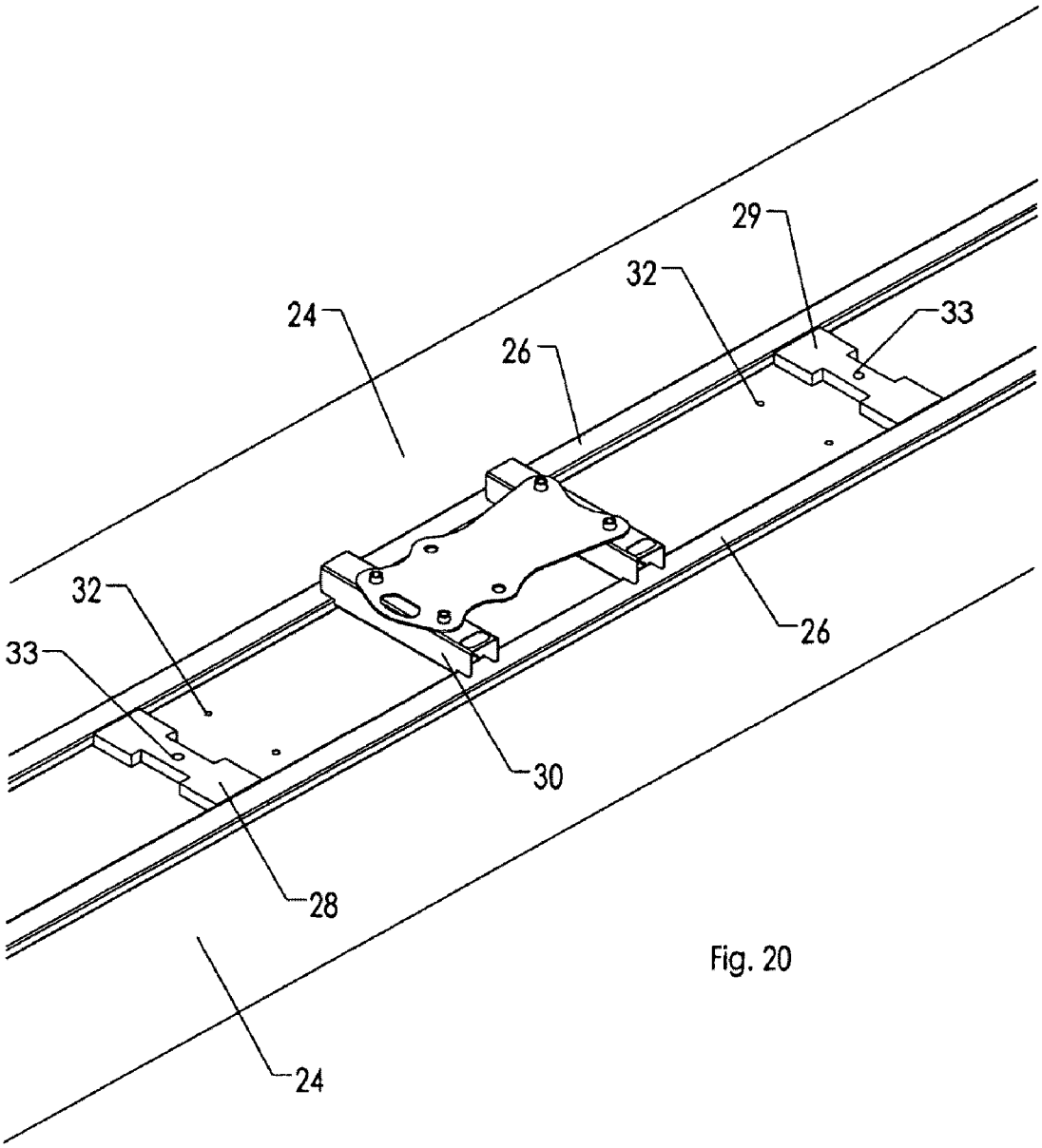
FIG. 20 is a perspective view of a footing and base for constructing a wall segment according to the invention.

Prior to using the formwork, a concrete footing 24 as shown in FIG. 20 is typically installed beneath the anticipated position of the wall segment. The concrete footing preferably fills in any lower areas, thereby leveling the ground.

A pair of longitudinal supports 26, which may be pieces of dimensioned lumber such as 2×4's, is installed onto the footing 24, separated by a distance equal to the desired thickness of the wall segment. First and second thickness spacers 28, 29, which may be notched pieces of 2×10 or similar dimensioned lumber, are placed between the longitudinal supports 26, separated by a distance equal to the desired length of the wall segment. Between the thickness spacers 28, 29, a rebar hole drilling guide 30 is used to mark holes 32 in the footing 24. The drilling guide 30 slides along the longitudinal supports 26 to position holes 32 at desired intervals (typically 16 inches or 24 inches). Markings, such as holes 33, are made in first and second thickness spacers 28, 29 to ensure end panels 2 will be properly located. Once the holes 32 are drilled, they are capped for protection until ready for use. In an alternate embodiment, bottom shoe 120 may be placed over the longitudinal supports, as best shown in FIG. 15, rather than using first and second thickness spacers 28, 29. Bottom shoe 120 also preferably comprises one or more holes or other markings which will ensure the end panels 2 can be properly located. In order to set the entire layout of a structure, it is contemplated that longitudinal supports 26 may be laid out for each of the wall segments which will comprise the completed structure. This allows consideration of the layout of the entire structure before beginning the heavier work of assembling the formwork and ramming the earth into the formwork, as will be described.

Figure 21:
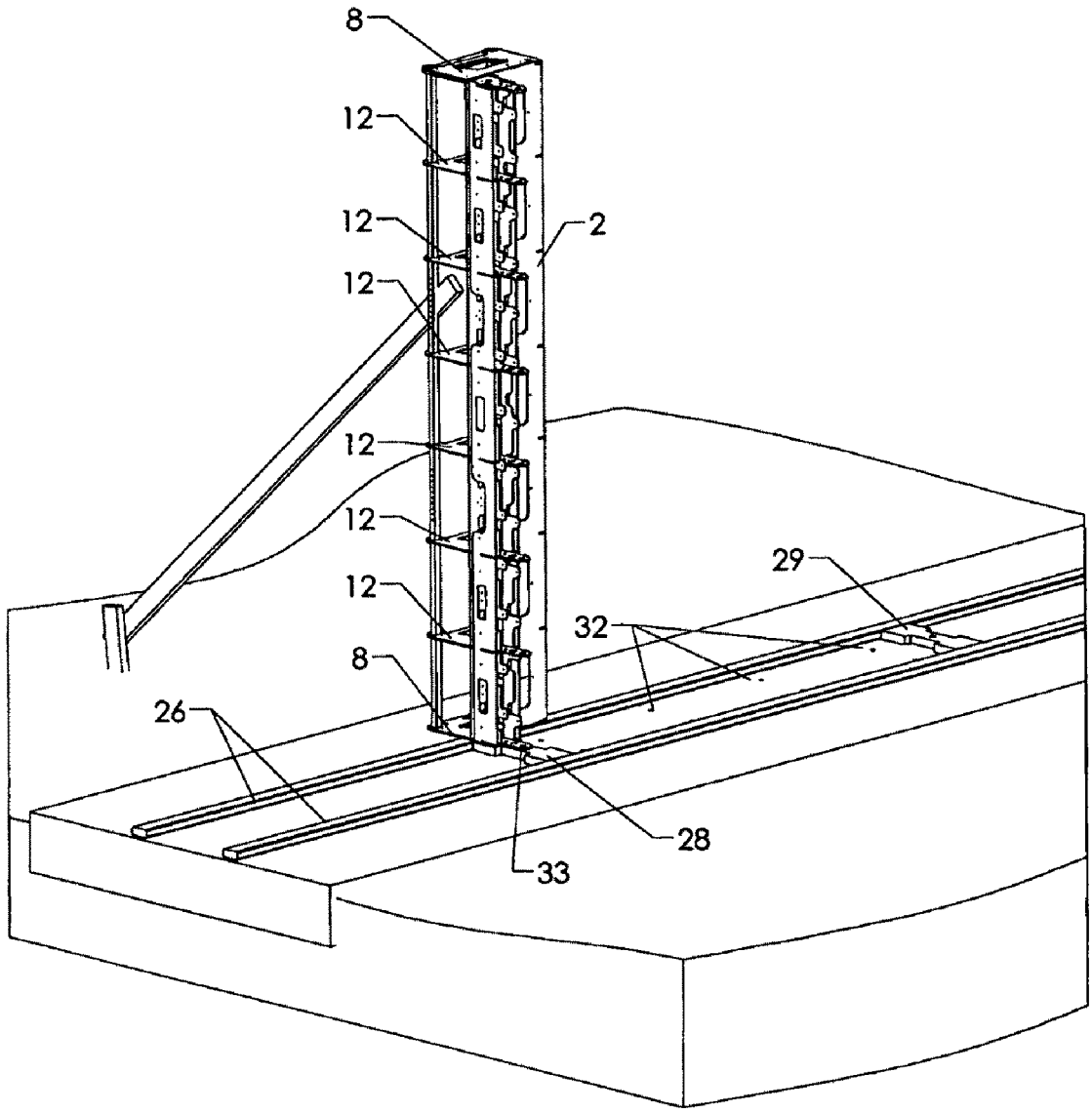
FIG. 21 is a perspective view of an end panel erected during construction of a wall segment according to the invention.
Figure 22:
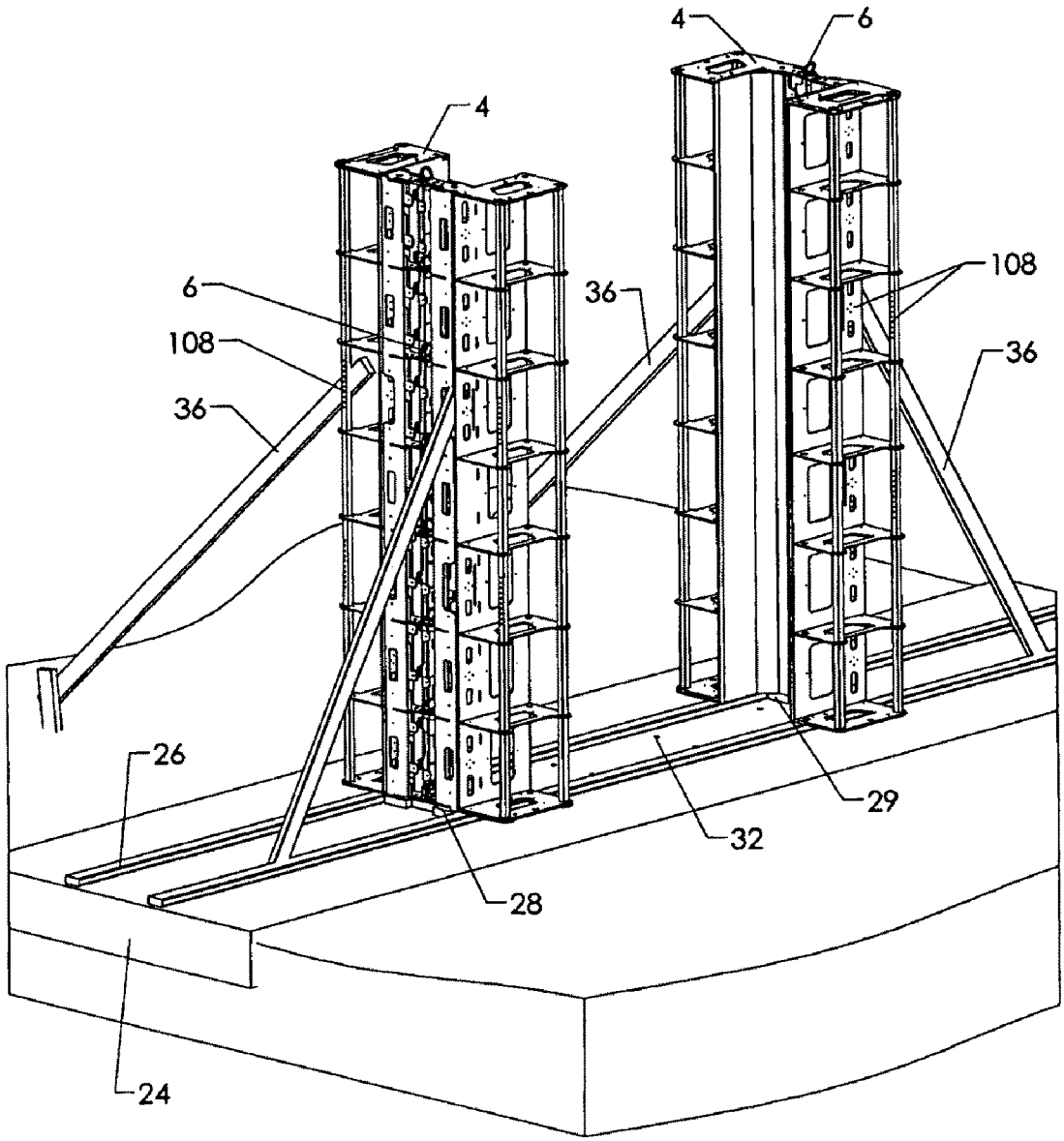
FIG. 22 is a perspective view of two end stops erected during construction of a wall segment according to the invention.

An end panel 2 is then positioned on top of part of the first thickness support 28 and one of the longitudinal supports 26 as shown in FIG. 21 and hitch pins (not shown) connect end panel 2 to hole 33 in first thickness support 28. As shown in FIG. 22 (and described above), a second end panel 2 is joined to the first end panel 2 to form an end stop 4 which faces the second thickness support 29. The end panels 2 at the other end of the wall segment are then positioned and connected in the same manner on the other second thickness support 29, to form an end stop 4 facing the first end stop 4.

It is also possible to construct each end panel 2 while it is lying on the ground, then to connect the two end panels together with hitch pins 6 to form an end stop 4, before placing end stop 4 in position atop the thickness support 28 or 29.

Figure 25:
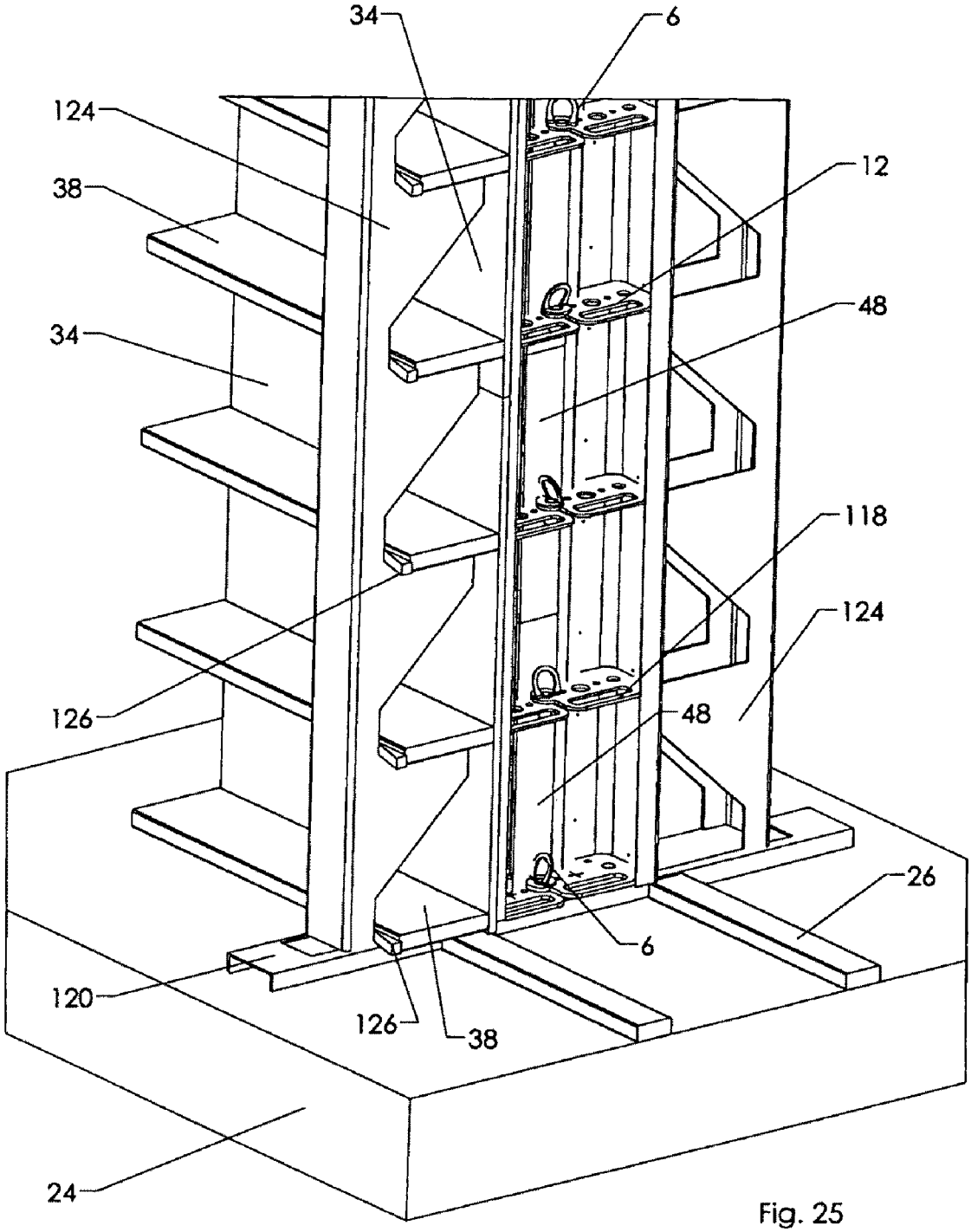
FIG. 25 is a perspective view of an alternate system to secure side panels during construction of a wall segment according to the invention.

Each end stop 4 may be checked with a built-in plumb checking mechanism, such as a plumb bob 132 (shown only in FIG. 25) to verify that it is plumb. The frame pieces may be formed with openings through which the plumb checking mechanism can be readily viewed, which makes the plumb bob easier to read, and speeds up the leveling process, or the plumb checking mechanism may be on an outer surface of the end panel, to ensure ease of access, as best shown in FIG. 25. Leveling pieces (not shown) under the end panels 2 ensure the end stops 4 are each square, while external braces 36 (best shown in FIG. 22) can be used to secure the end stops 4 in the proper position. End stops 4 may comprise attachment holes 108, to allow fast and easy attachment of external braces 36.

Plywood liners may be inserted within each end stop to create wall segments with different end face shapes. In addition to this design flexibility, plywood liners also tend to decrease the amount of time required to clean the formwork between uses, as earth rammed into the cavity tends not to stick to the plywood liners.

Figure 23:
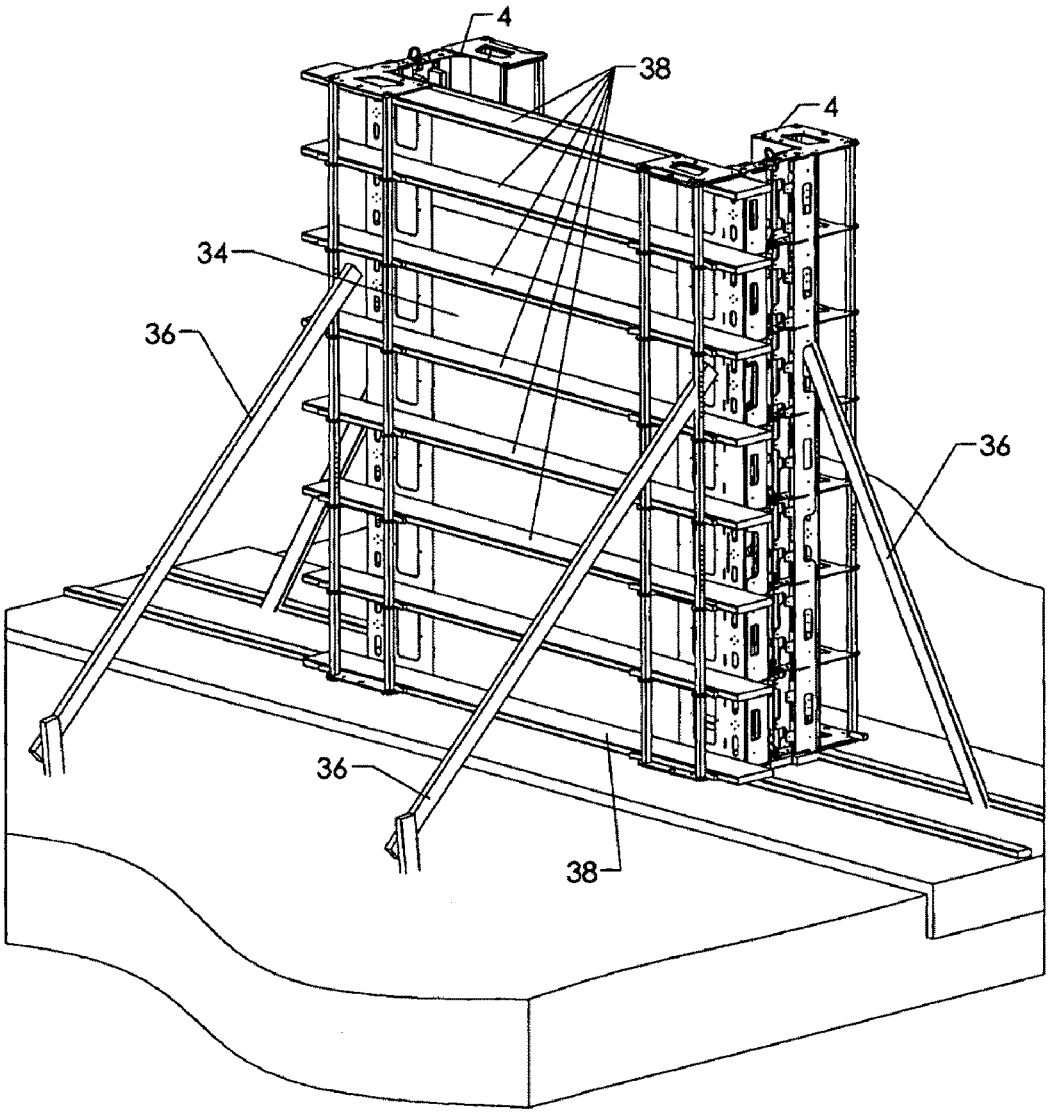
FIG. 23 is a perspective view of a back side panel during construction of a wall segment according to the invention.
Figure 26:
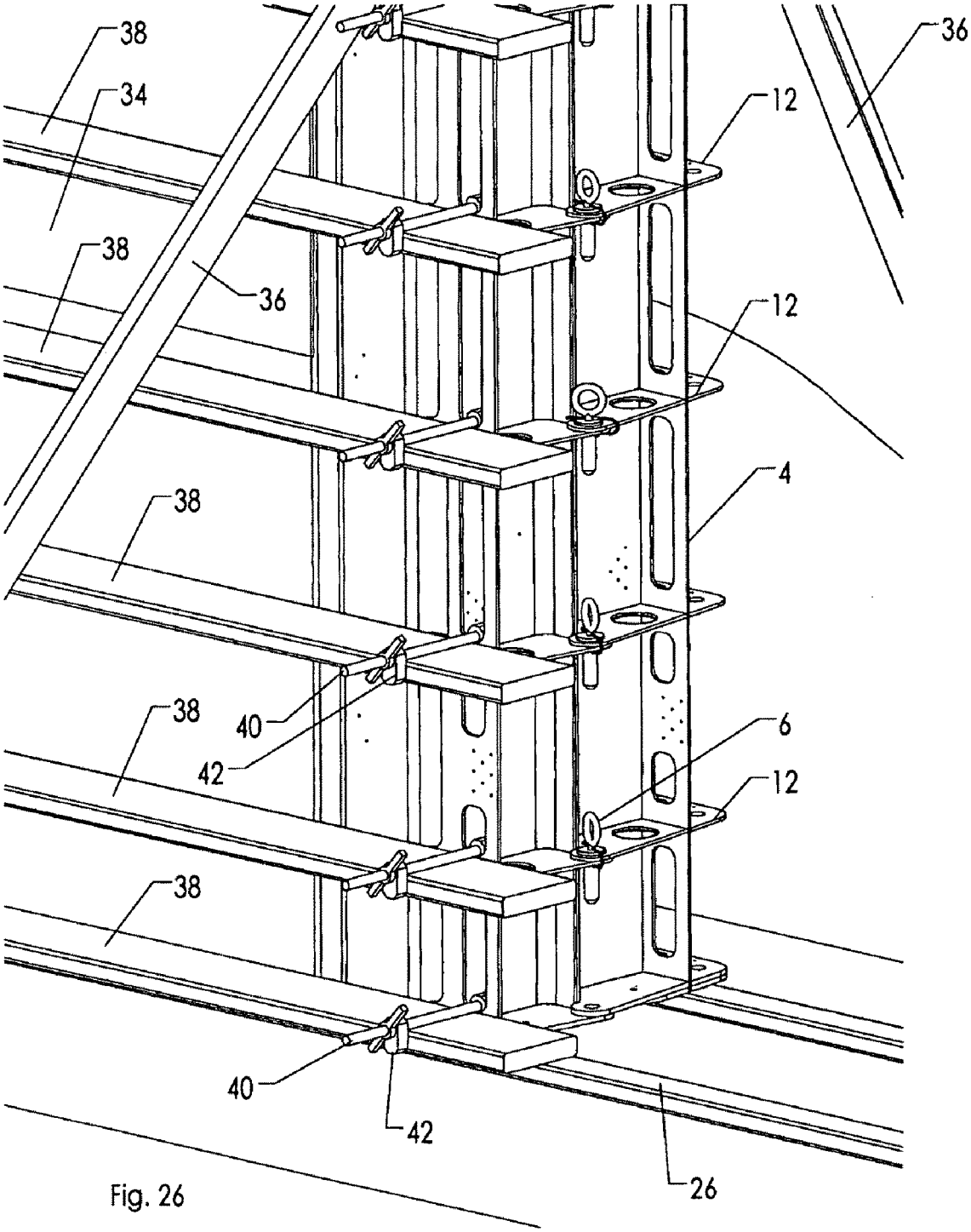
FIG. 26 is a perspective view of an alternate system to secure side panels during construction of a wall segment according to the invention.

Referring now to FIG. 23, to construct a wall segment, a back side panel 34 is inserted into one side (preferably the back or non-fill side) of the wall on top of one of the longitudinal supports 26 between the end stops 4. Each end of the back side panel 34 abuts an elongated key strip 20 (best shown in FIG. 27) in each end panel 2. Elongated key strip 20 extends slightly out from the straight edge of back side panel 34, effectively "hiding" the seam that would otherwise appear at the ends of each back side panel 34 by providing a more aesthetically-pleasing groove in the wall. Corner key pieces 128 (not shown) may also be inserted to provide a selected configuration to the corner of the wall segment. Walers 38 placed on each of the lowest shelves 8, 12 of the end stops 4 laterally support the back side panel 34. Steel rods 40 may be connected by any suitable method, such as clamps 42, to securely hold each waler 38 in place on a shelf, as best shown in FIG. 26. The process is repeated on the back side of the wall segment until the height of the back side panel 34 reaches the height of the end stops 4, as shown in FIG. 23.

Figure 24:
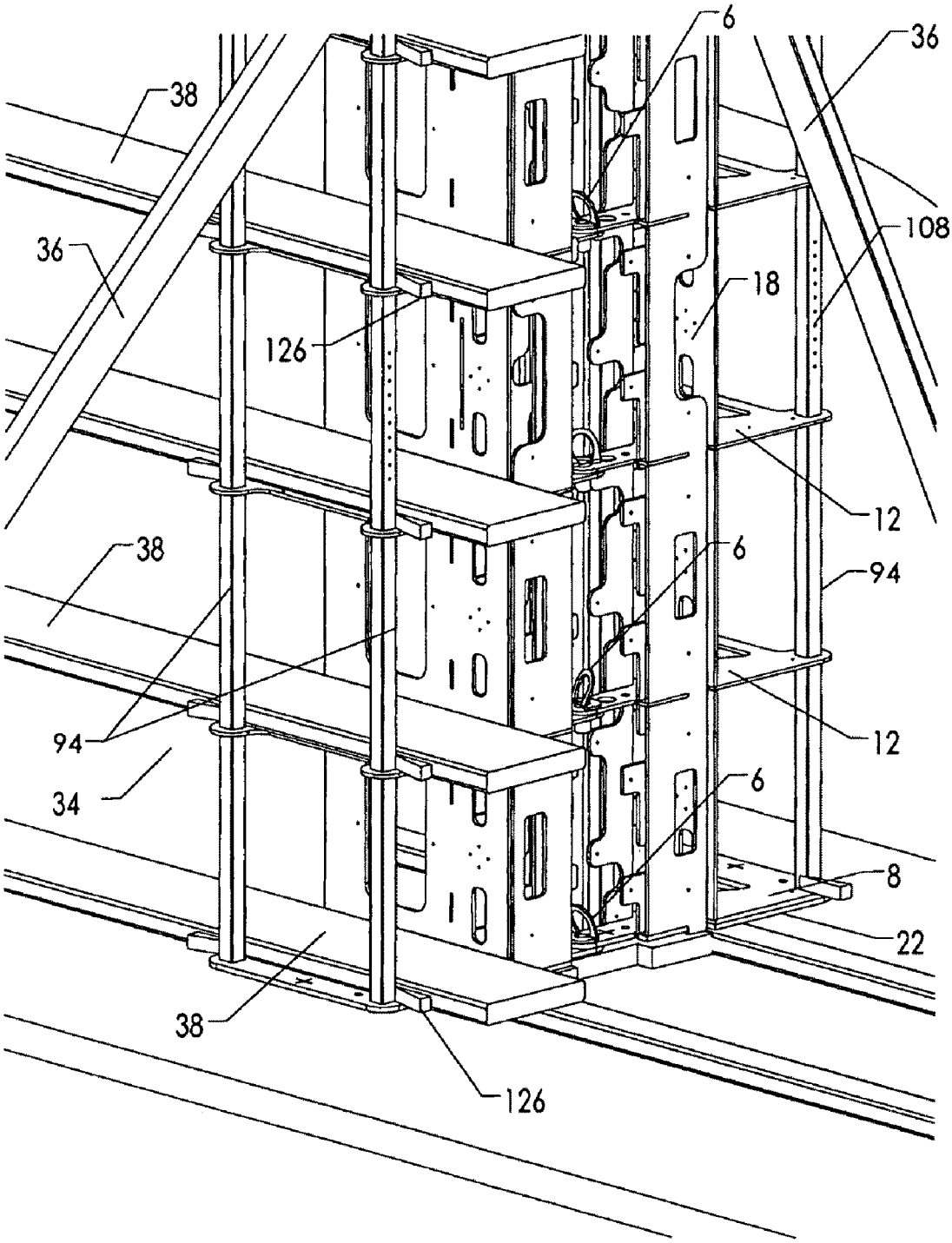
FIG. 24 is a perspective view of a system to secure side panels during construction of a wall segment according to the invention.

If the end panel 2 has a vertical member to support the walers 38 as described in the alternate embodiments above, walers 38 may be inserted between the vertical member and the end stop 4, and may be secured, if necessary, by any suitable means such as clamps 42 or wedges 126, as best shown in FIGS. 24-26. Additional means, such as screws (not shown), may be used to directly connect the walers to the support shelves. Using a vertical member such as vertical member 94 (FIG. 24) or strongback 124 (FIG. 25) allows faster assembly and easier alignment of the walers. It is also less wasteful of material, particularly the plywood side panels, which often have to be drilled to clamp the walers in place, thereby rendering the side panel useless for constructing further wall segments.

Figure 27:
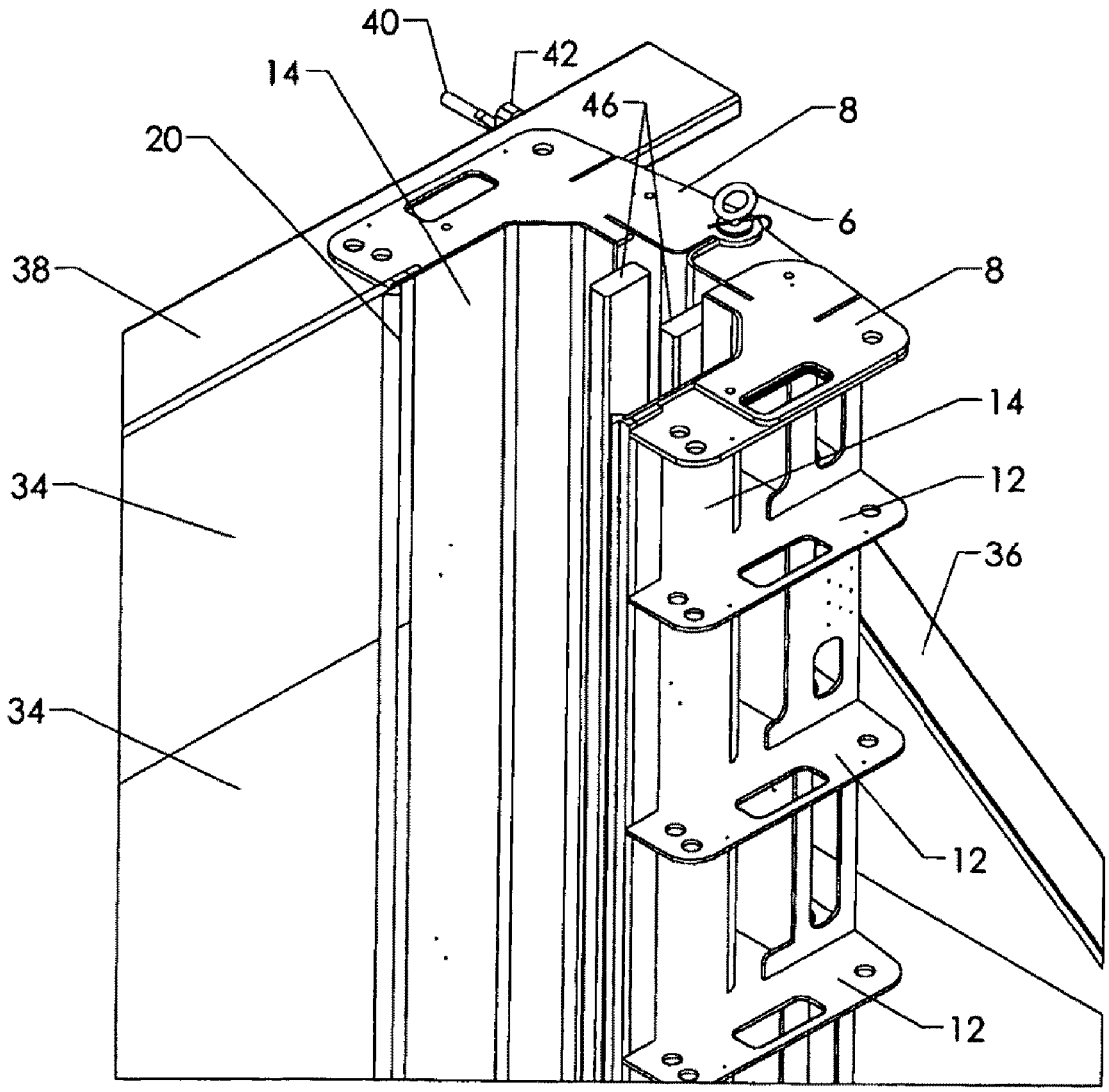
FIG. 27 is a perspective view of an internal frame during construction of a wall segment according to the invention.
Figure 28:
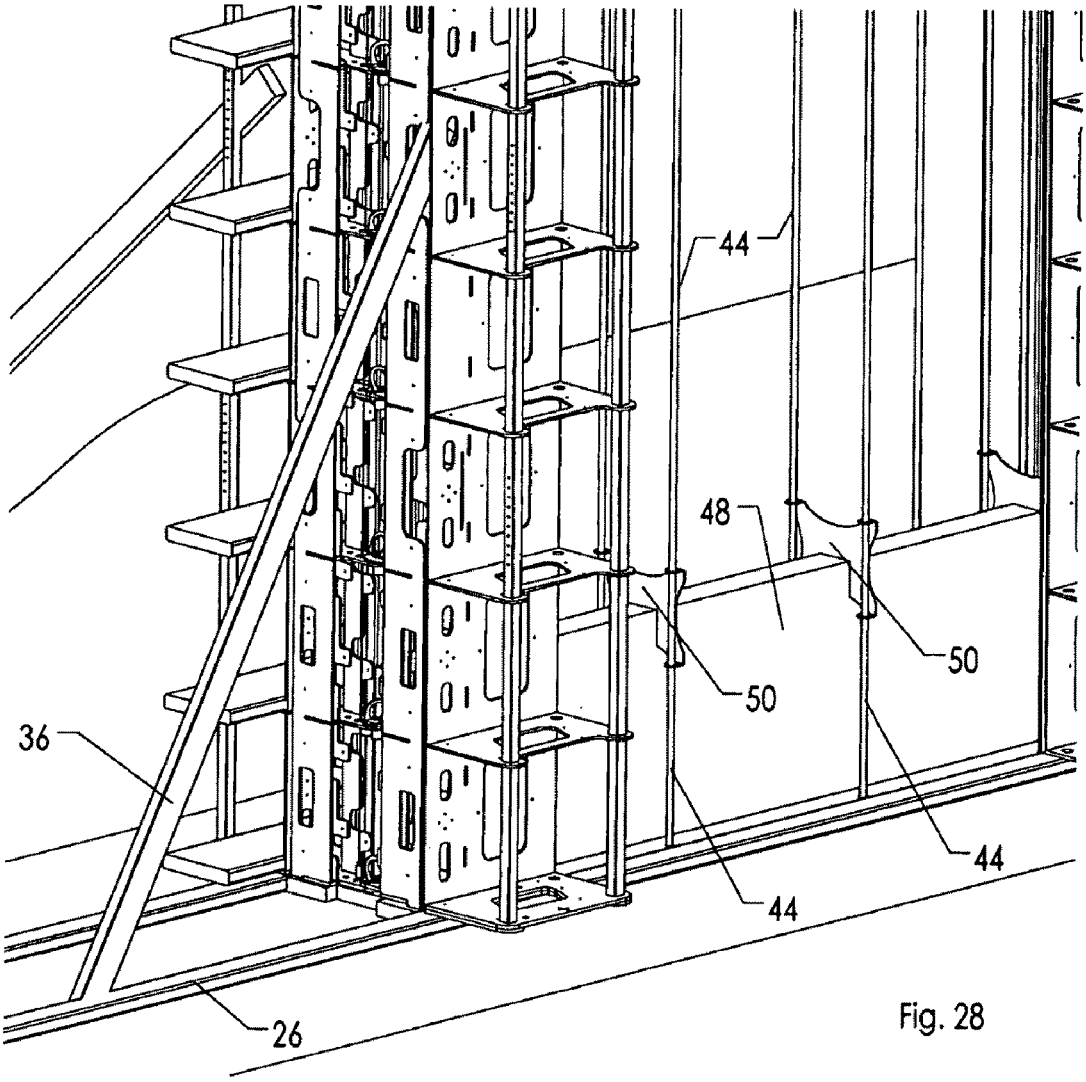
FIG. 28 is an enlarged perspective view of the front side of the wall segment during construction of a wall segment according to the invention.
Figure 29:
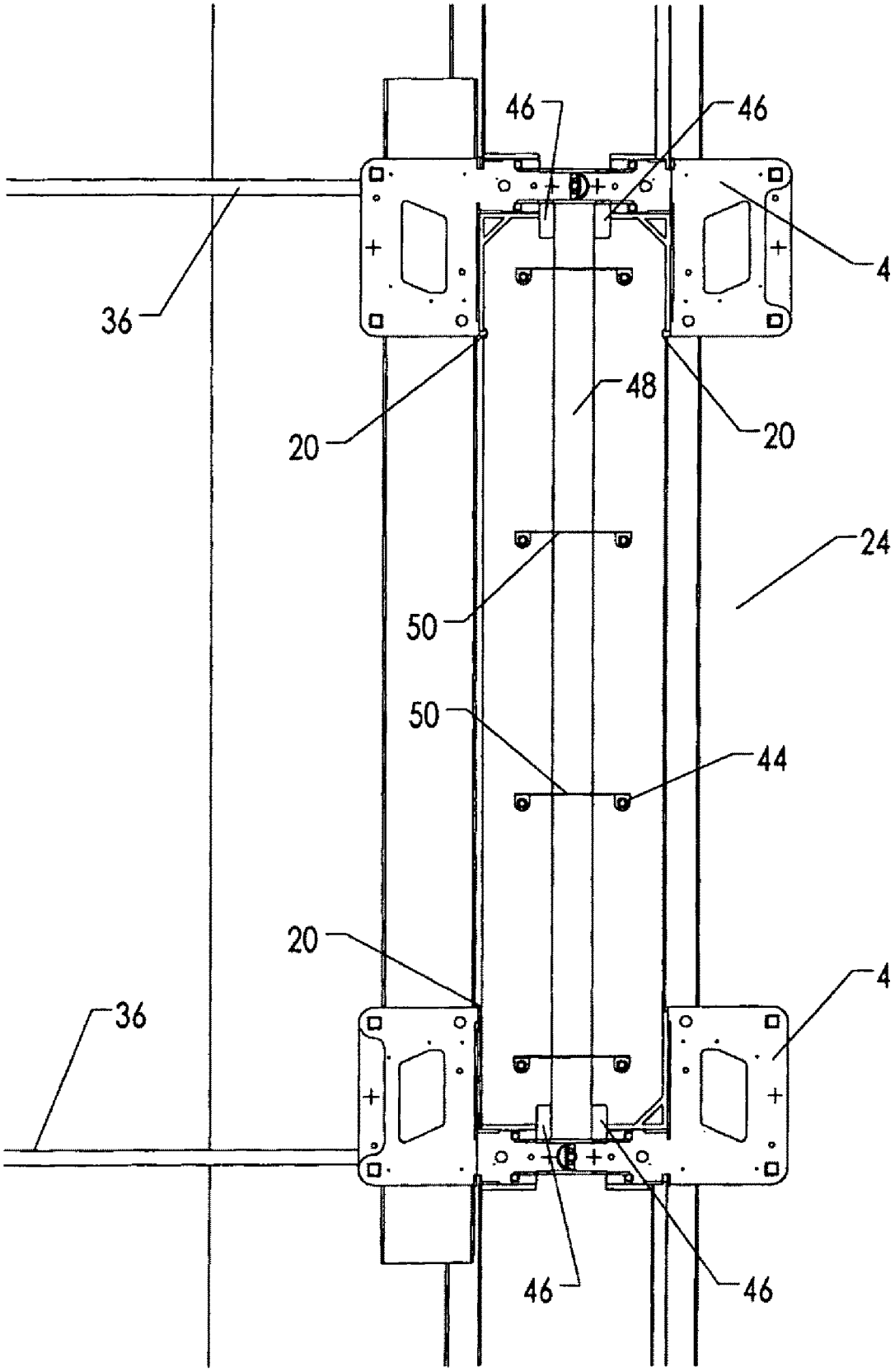
FIG. 29 is a top view of the interior of a wall segment during construction of the wall segment according to the invention.

Once the back side panels 34 are assembled, an internal frame for the insulating core is formed by inserting and securing two elongated pieces of a suitable insulating, rot-proof material 46 (such as wood/plastic building material TREX®) along the length of each end stop 4. As best shown in FIGS. 27 and 29, the pieces of TREX® 46 on each end stop 4 are separated, for example by approximately 4 inches for an 18-inch wall thickness. The caps are then removed from the holes 32 in the footing 24, and vertical rebar supports 44 are inserted in the manner shown in FIGS. 28 and 29, and secured by any suitable method, such as by epoxy. One or more pieces of suitable insulating material 48, such as foam, are then dropped between the TREX® 46 into the bottom portion of the wall segment, along the entire wall section.

Figure 30:
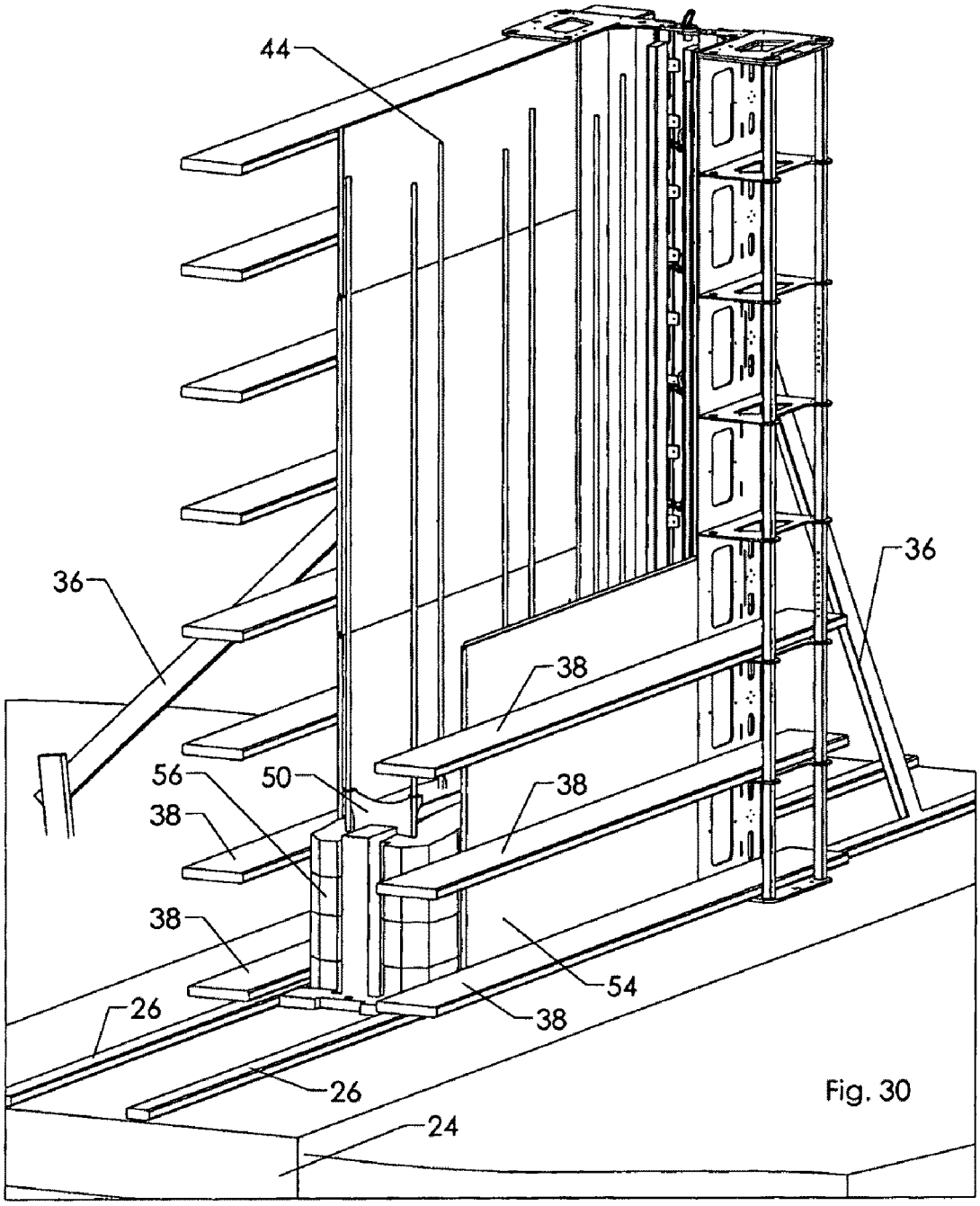
FIG. 30 is a perspective view of a partial wall segment during construction of the wall segment according to the invention.

As best seen in FIG. 30, front side panel 54 is then placed into the front side of the wall segment, between the end stops 4, abutting elongated key strips 20. Preferably this front side panel 54 is approximately 48 inches in height. Walers 38 support the front side panel 54. Walers 38 may be secured by any appropriate method, such as steel rods 40 and clamps 42, or wedges 126, in a similar manner to those shown in FIGS. 24-26.

If the wall segment is to be relatively long, vertical stiffeners may be placed at one or more intermediate positions between the end stops. Each vertical stiffener would preferably be attached to the footing of the wall segment, and then attached over the top of the wall segment to a vertical stiffener on the opposite side of the wall segment. The vertical stiffeners serve to maintain the thickness of the wall during the ramming process, without the need for through ties, which could compromise the integrity of the wall segment. If desired, vertical stiffeners may be strongbacks 124 (as in FIG. 25), which would also provide additional shelving to support the walers 38 at intermediate points along the wall segment.

Earth 56 may then be rammed partway up the height of front side panel 54. An interwythe connector (IWC) 50 is dropped over each pair of rebar supports 44, into the top surface of the insulating material 48 and rammed earth 56, and partially imbedded therein, as shown in FIG. 30.

Figure 31:
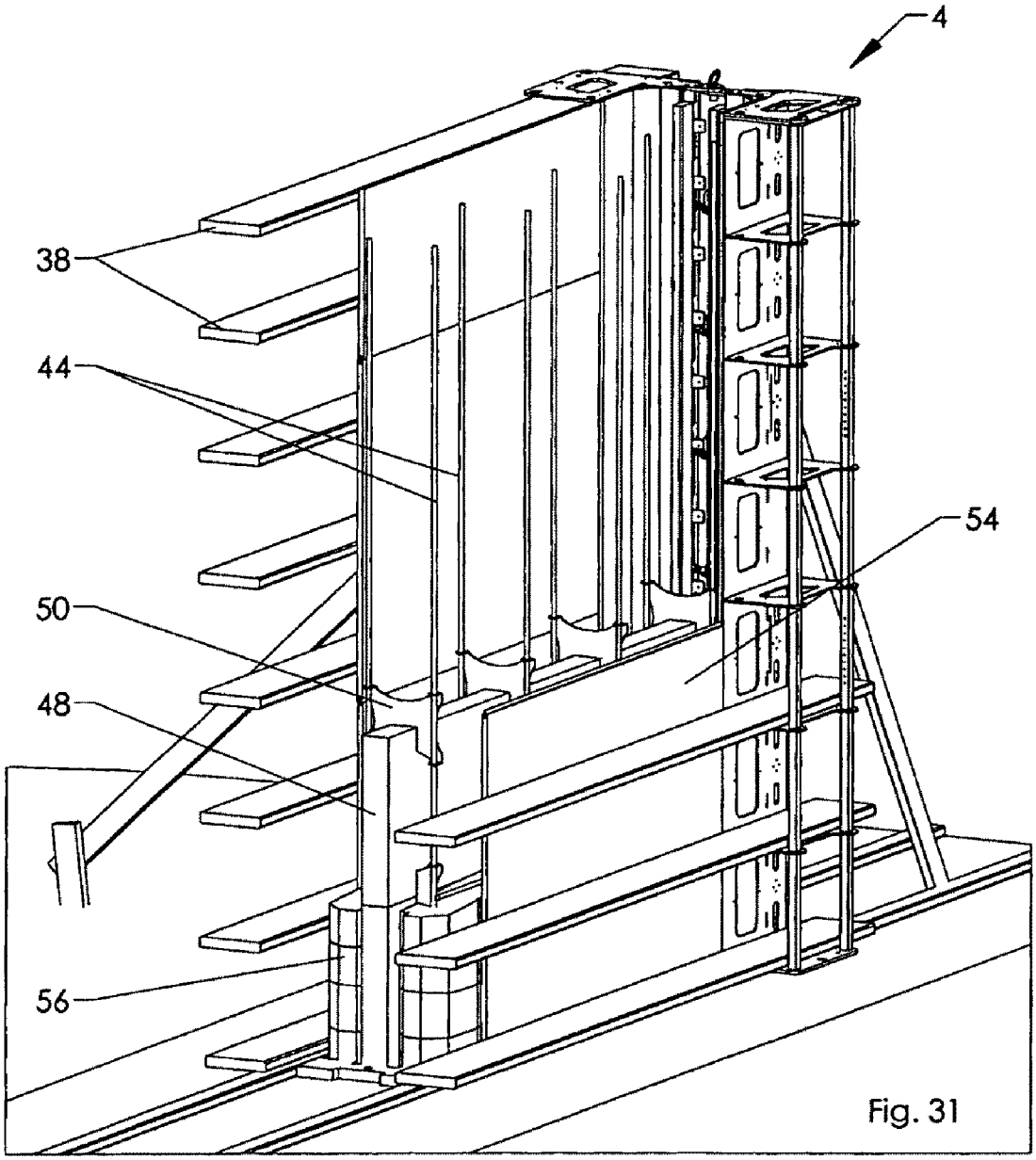
FIG. 31 is a perspective view of a partial wall segment during construction of the wall segment according to the invention.

More earth 56 is placed into the space between the end and side panels and rammed. This operation may take place several times, until the rammed earth 56 comes approximately half way up the front side panel 54, as shown in FIG. 31. Once the earth 56 has reached this point, pieces of horizontal rebar 58 (not shown) are placed on the rammed earth 56 between the end stops 4, one or more pieces of insulating material 48 is dropped between the TREX® 46, and another IWC 50 is placed over each pair of rebar supports 44 and embedded in the insulating material 48. Earth 56 is then added and rammed until the level reaches near the top of the front side panel 54.

Figure 32:
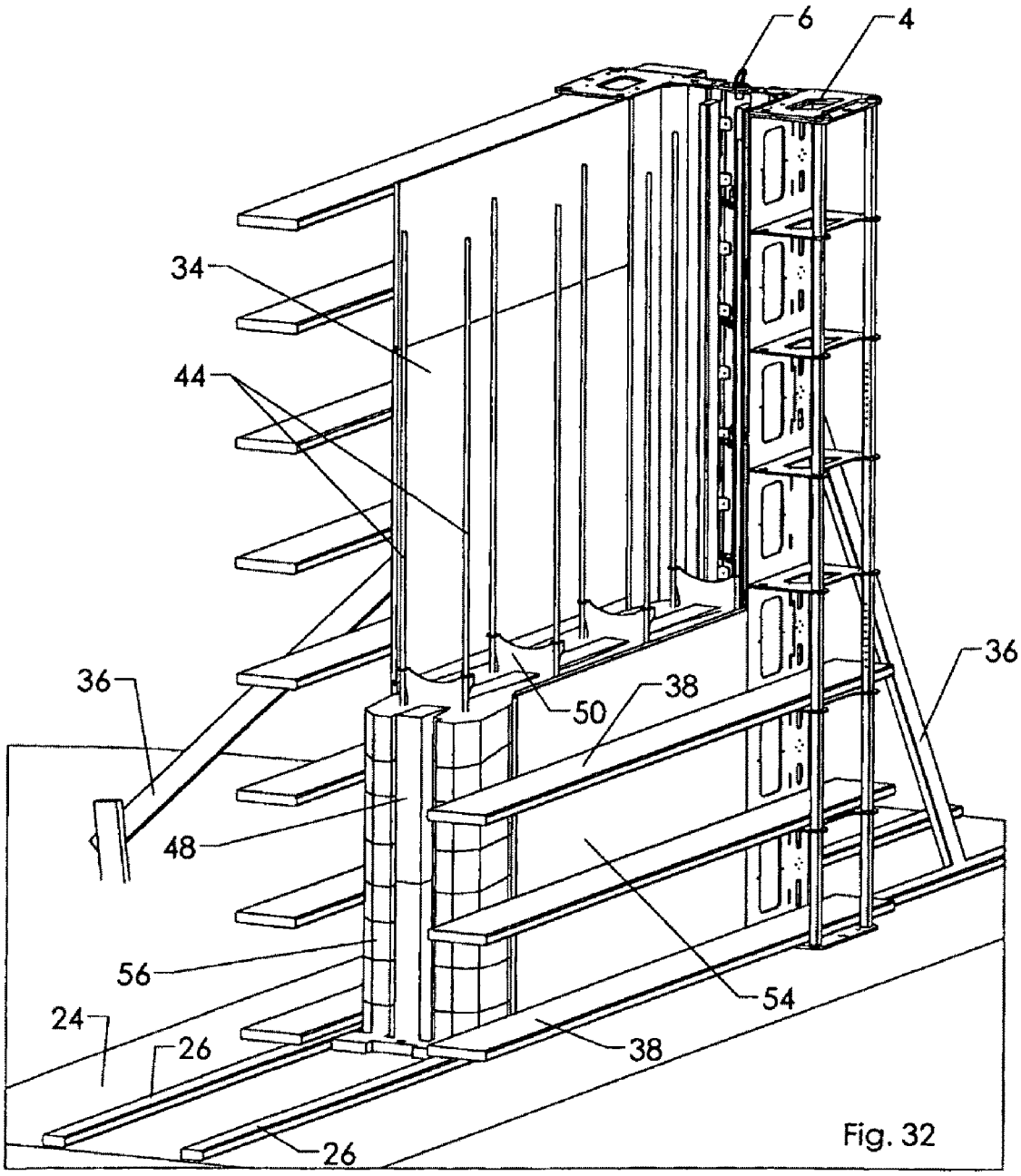
FIG. 32 is a perspective view of a partial wall segment during construction of the wall segment according to the invention.

At this point, another front side panel 54 is secured with walers 38, steel rods 40 and clamps 42 to the front side of the wall segment, and the entire process is repeated, as shown in FIG. 32. The process is repeated as many times as necessary to bring the level of rammed earth 56 to within approximately 10 inches of the top of the end stops 4. The space intended to leave room for the installation of a bond beam 62 (shown only in FIGS. 34 and 35).

Figure 33:
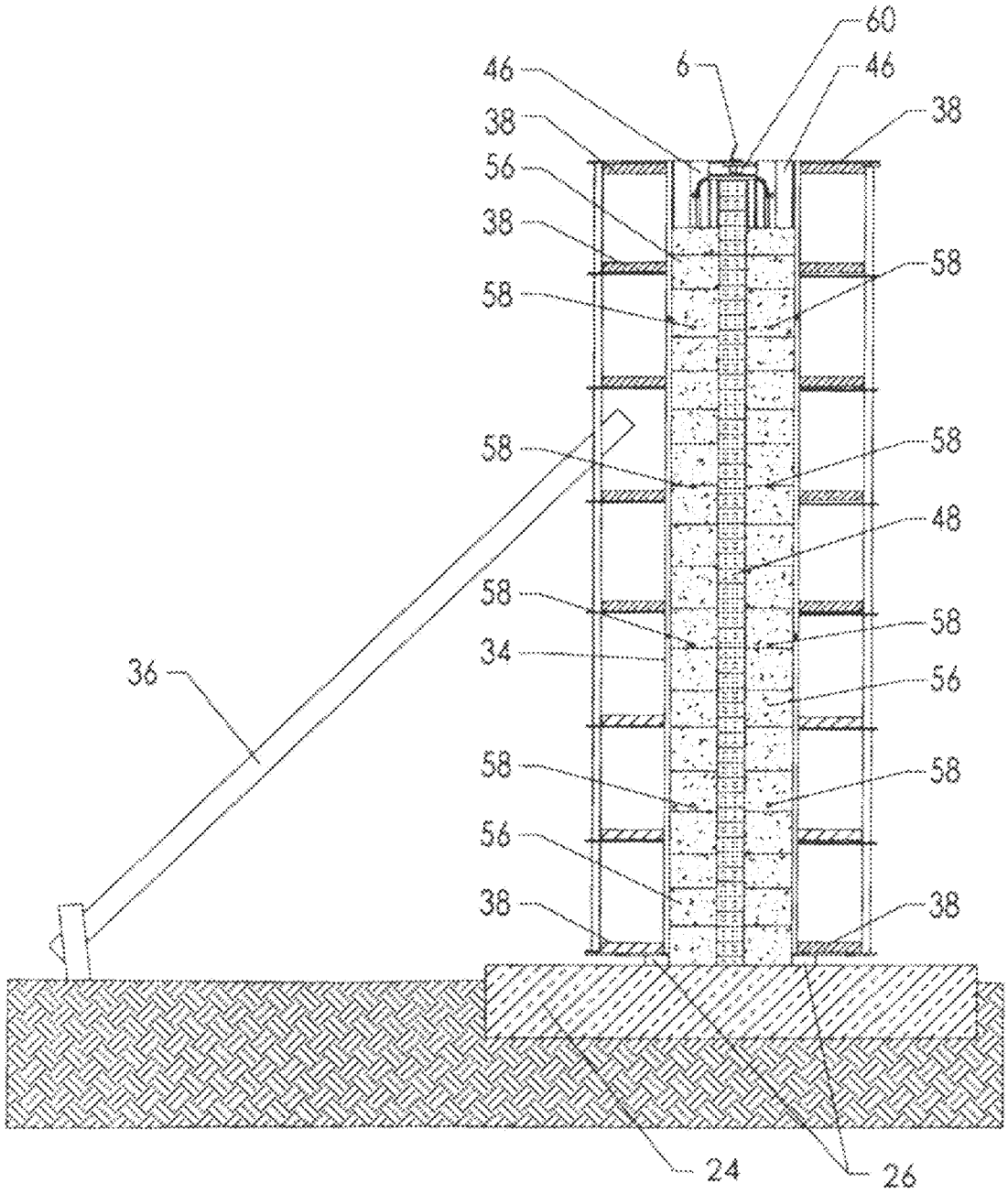
FIG. 33 is a side elevation view of the side of a wall segment during construction of a wall segment according to the invention.
Figure 34:
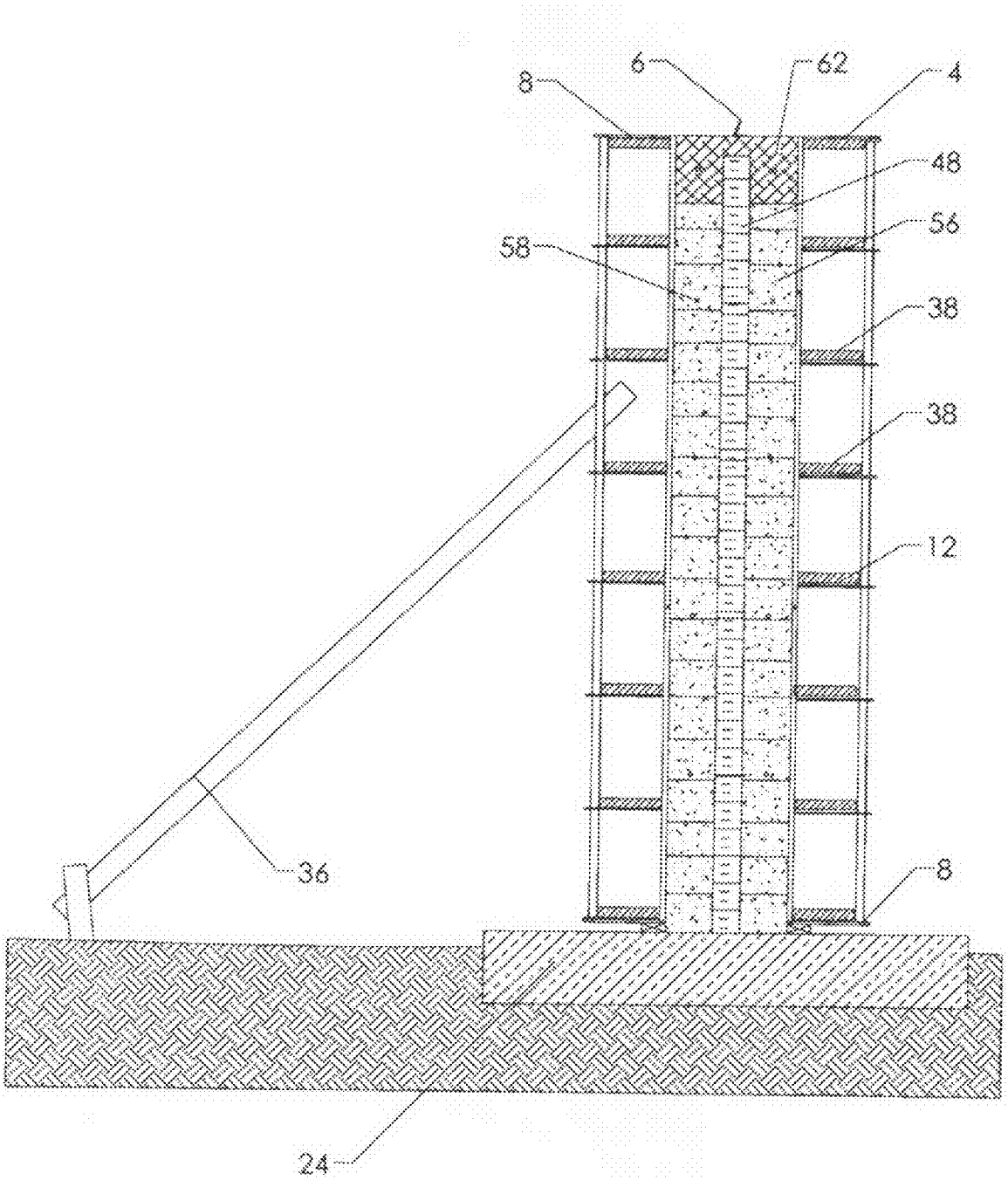
FIG. 34 is a side elevation view of a completed wall segment constructed according to the invention.

As shown in FIG. 33, U-shaped rebar 60 is installed across the tops of each pair of vertical rebar supports 44 (not shown) to provide additional support. More pieces of horizontal rebar 58 may be placed at the top of the wall and the top of the bond beam 62 (not shown) may be smoothed to the level of the top of the end panels.

Figure 35:
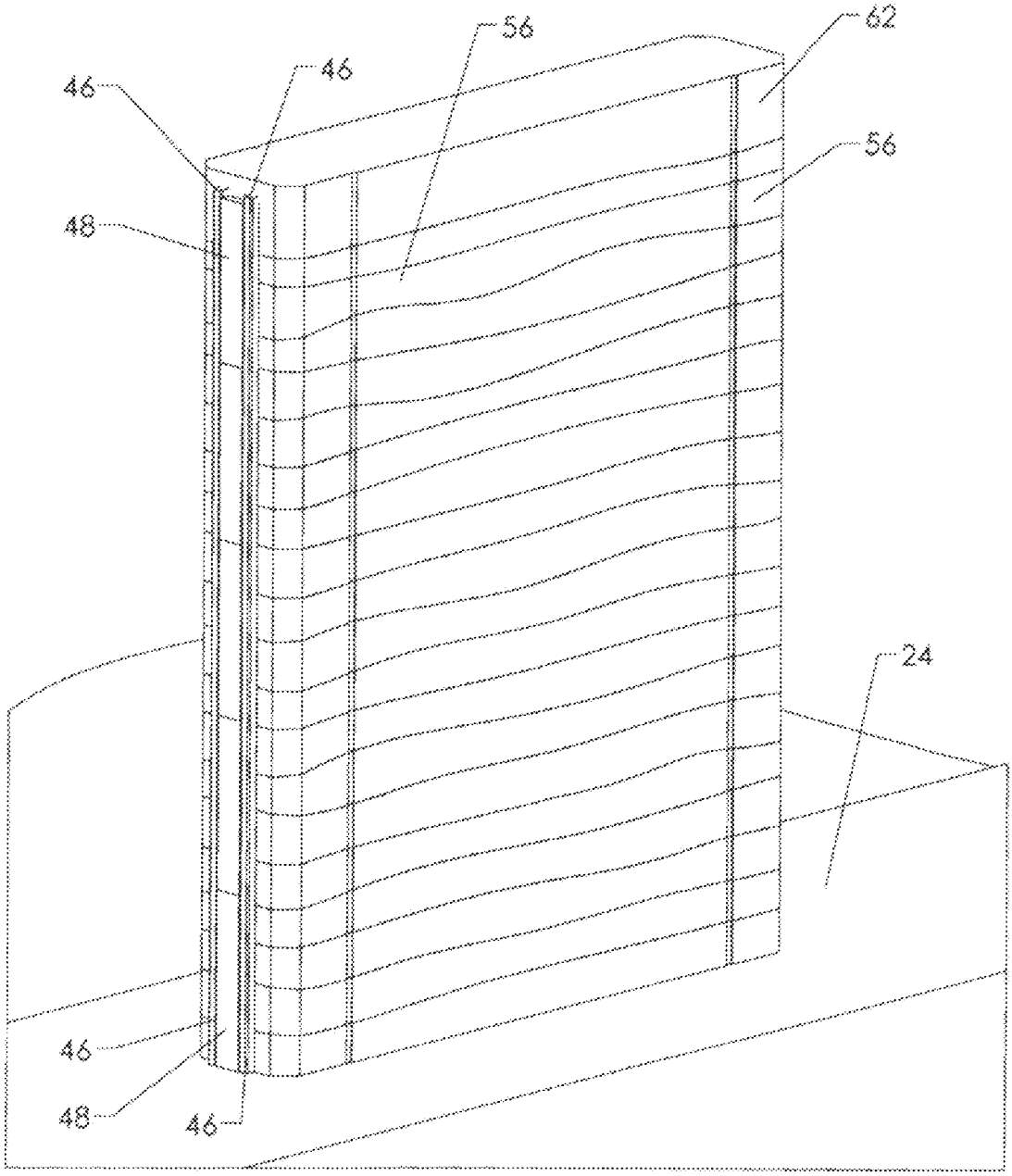
FIG. 35 is a perspective view of a completed wall segment constructed according to the invention.
Figure 36:
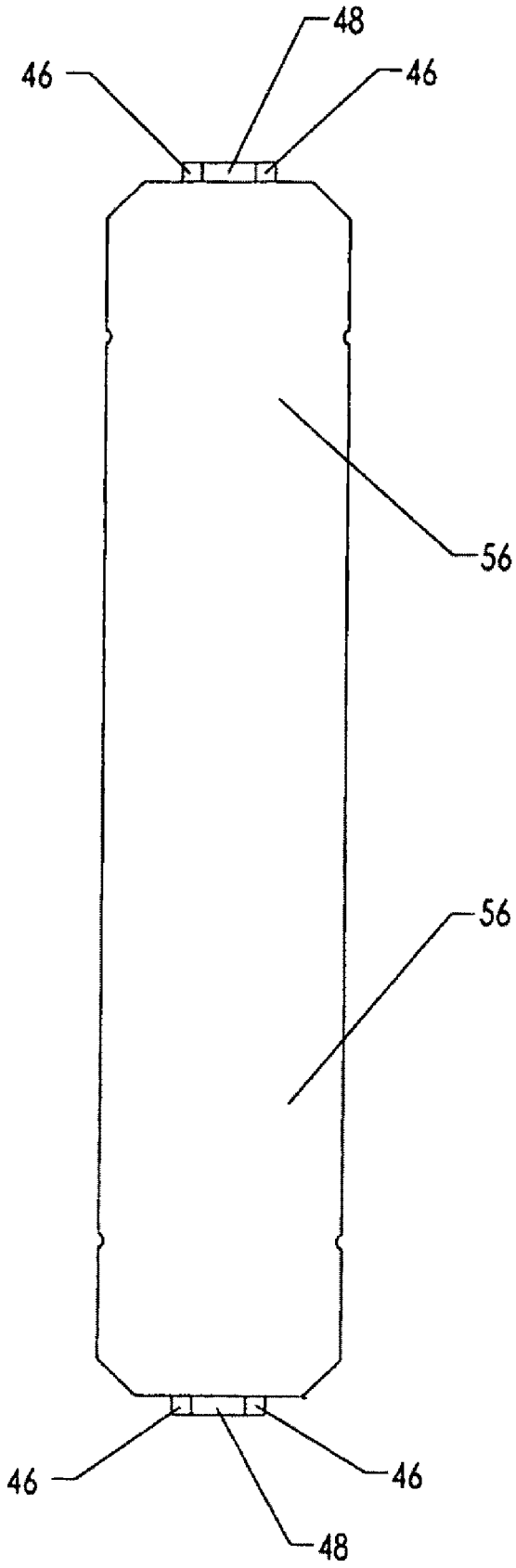
FIG. 36 is a top view of a completed wall segment constructed according to the invention.

The formwork is then removed, leaving a finished wall as shown in FIGS. 35 and 36. Generally, one would remove the front side panel 34 and back side panel 54, then remove the end panels 4. Preferably TREX® 46 and insulation 48 protrude slightly from the ends of the wall, to minimize the thermal bridge that exists between the wall segment and a door or window frame in the wall segment. The protruding TREX® 46 may also be used as a support for a window flange or other external structure which may be connected to it, as desired, to maintain the airtight integrity between the external structure and the wall segment.

Figure 37:
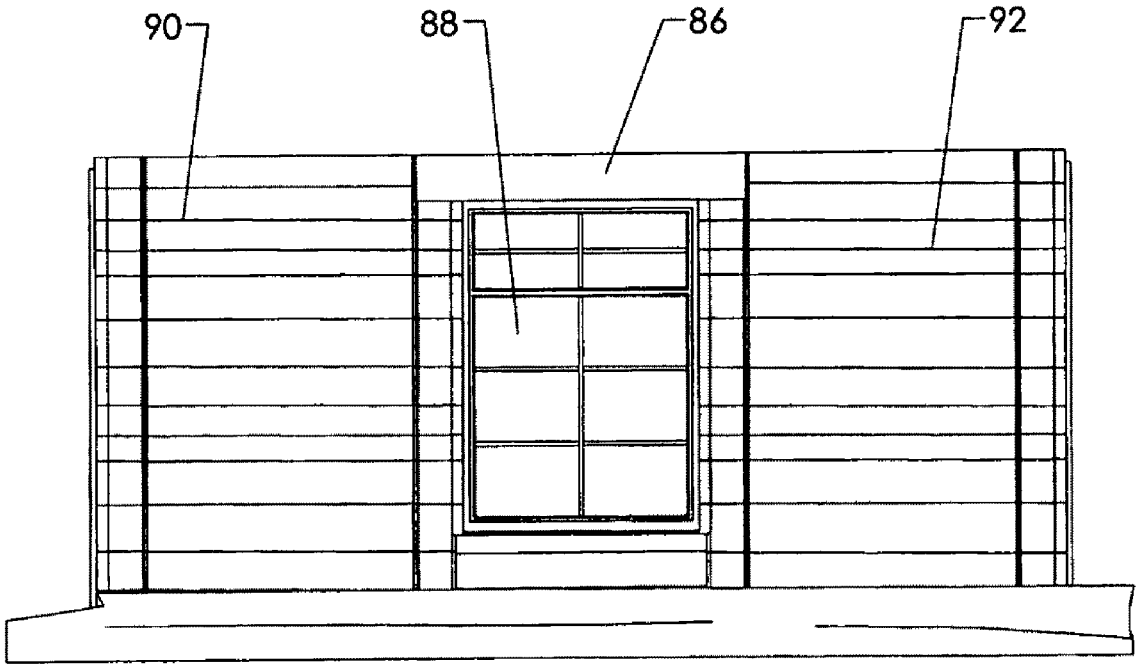
FIG. 37 is a perspective view of a wall segment containing a formwork piece to create a void.

The method described above produces a wall section with an essentially flat top. Another embodiment of the invention allows building of wall sections with a lintel 86 over the top of a door or window 88 as shown in FIG. 37. At any point during the ramming process, a formwork piece may be inserted into the wall segment 90, around which further earth will be rammed. This creates a void in the wall segment 90 which accommodates the window 88. Two adjacent wall segments 90, 92 may be shaped in this manner, and a lintel 86 may then be dropped into place between the wall segments over the void 88.

Other variations to the preferred embodiment described herein may be practiced without departing from the scope of the invention, which scope is defined by the following claims.

What is claimed is:

1. A formwork system for a rammed earth structure having a desired height, comprising:

first and second elongated end stop structures vertically extending substantially said desired height;

said first and second end stop structures comprising a plurality of elongated flat frame members, each extending substantially vertically and parallel to one another;

said first and second end stop structures mountable in opposed spaced relation to one another to define a length of said rammed earth structure;

a plurality of wall face-defining structures mountable in opposed spaced relation on said mounted first and second end stop structures, thereby defining a cavity to contain rammed earth; and first and second internal frames supported within each of said first and second end stop structures, said first and second internal frames supporting an insulating foam core within said cavity.

2. The system of claim 1, wherein said first and second end stop structures comprise a plurality of supports extendable along the elongated vertical extent of each of said end stop structures, and said plurality of wall face-defining structures comprise a plurality of members extendable at least between said supports on one of said end stop structures and said supports on the other of said end stop structures to define said length.

3. The system of claim 2 further comprising means to secure said members to said supports on each of said end stop structures.

4. The system of claim 3 wherein said means to secure said members comprises wedges.

5. The system of claim 3 wherein said means to secure said members comprises clamps.

6. The system of claim 3 wherein said plurality of supports are evenly spaceable along said elongated vertical extent.

7. The system of claim 6 wherein said plurality of supports comprise a plurality of shelves.

8. The system of claim 7 wherein each of said shelves is co-planarly connectable to another of said shelves, to define an adjustable distance between said wall face-defining structures.

9. The system of claim 3 wherein said plurality of members extends beyond the supports on at least one of said end stop structures.

10. The system of claim 1 wherein each of said end stop structures further comprises a vertically extended elongated end face-defining member and an elongated brace structure.

11. The system of claim 10 wherein said end face-defining member comprises an elongated curved frame member.

12. The system of claim 1, further comprising at least one vertical stiffener extending along the vertical elongated extent of each of said end stop structures, and said plurality of wall face-defining structures comprise a plurality of members extending at least between said stiffener on one of said end stops and said stiffener on the other of said end stops.

13. The system of claim 12 further comprising at least one vertical stiffener positionable along said wall face-defining structures, outside said cavity.

14. The system of claim 12 wherein said plurality of members extend beyond the stiffener on at least one of said end stop structures.

15. The system of claim 1 further comprising longitudinal supports installable along said length of said rammed earth structure.

16. The system of claim 15 further comprising a plurality of thickness spacers mountable perpendicular to said longitudinal supports, upon which said first and second end stop structures may be mounted.

17. The system of claim 16 wherein said thickness spacers further comprise means to locate said first and second end stop structures in a position centered over said thickness spacers.

18. The system of claim 17 further comprising means to secure said end stop structures to said thickness spacers in said position.

19. The system of claim 1 wherein said insulating core and said internal frames protrude from said rammed earth structure after said earth is rammed into said cavity.

20. The system of claim 1 further comprising a plurality of internal supports insertable into said cavity.

21. The system of claim 20, further comprising means to locate and drill holes into which said internal supports may be inserted.

22. The system of claim 1, further comprising a form insertable into said cavity to define a void in the rammed earth structure.

23. The system of claim 1, further comprising means to verify the plumb of said end stop structures and means to adjust the plumb of said end stop structures.

24. The system of claim 23, wherein said means to verify said plumb comprise a plumb-checking mechanism which is integral with said end stops.

25. The system of claim 24, wherein said means to adjust said plumb of said end stop comprise leveling plates.

26. The system of claim 24 or 25 wherein said means to adjust said plumb of said end stop comprise external braces.

27. The system of claim 1, further comprising an elongated strip vertically insertable into each of said end stop structures along said elongated extent, thereby creating shaped grooves in said rammed earth structure.

28. The system of claim 1 wherein each of said end stop structures further comprises a curved interior frame structure.

29. A method of constructing a rammed earth structure having a desired height, comprising the steps of:

providing first and second vertically elongated end stop structures extending substantially said desired height;

mounting said first and second end stop structures in opposed spaced relation to one another to define a length of said rammed earth structure;

mating said first and second end stop structures with a plurality of wall face-defining structures, thereby defining a cavity;

inserting a first internal frame within said first end stop structure;

inserting a second internal frame within said second end stop structure;

said first and second internal frames being adapted to support an insulating core;

inserting an insulating core into said cavity such that said insulating core is at least partially supported by said internal frames and extends into said end stops; and ramming earth into said cavity about said insulating core.

30. The method of claim 29 wherein said step of mating said first and second end stop structures comprises the step of mounting said plurality of wall face-defining structures in opposed spaced relation on said mounted first and second end stop structures, thereby defining said cavity.

31. The method of claim 30, wherein said first and second end stop structures comprise a plurality of supports extending along the vertically elongated extent of each of said end stop structures, and said plurality of wall face-defining structures comprise a plurality of members extending at least between said supports on one of said end stop structures and said supports on the other of said end stop structures.

32. The method of claim 31 further comprising the step of securing said members to said supports on each of said end stop structures.

33. The method of claim 32 wherein said step of securing said members comprises installing wedges between said supports and said members.

34. The method of claim 32 wherein said step of securing said members comprises clamping said members to said supports.

35. The method of claim 31 comprising the further step of evenly spacing said plurality of supports along said vertically elongated extent.

36. The method of claim 11 wherein said plurality of supports comprise a plurality of shelves.

37. The method of claim 36 wherein each of said shelves is co-planarly connectable to another of said shelves, to define an adjustable distance between said wall face-defining structures.

38. The method of claim 31 wherein said plurality of members extend beyond the supports on at least one of said end stop structures.

39. The method of claim 30, further comprising at least one vertical stiffener extending along the vertically elongated extent of each of said end stop structures, and said plurality of wall face-defining structures comprise a plurality of members extending at least between said stiffener along one of said end stop structures and said stiffener along the other of said end stop structures.

40. The method of claim 39 further comprising at least one vertical stiffener positioned along said wall face-defining structures, outside said cavity.

41. The method of claim 39 wherein said plurality of members extend beyond the stiffener on at least one of said end stop structures.

42. The method of claim 29 wherein said step of providing said end stop structures comprises mating a vertically elongated end face-defining member with a vertically elongated brace structure to form each of said end stop structures.

43. The method of claim 42 wherein said end face-defining member comprises a vertically elongated curved frame member.

44. The method of claim 29 wherein each of said end stop structures comprises a plurality of vertically elongated flat frame members.

45. The method of claim 44 wherein each of said end stop structures further comprises an L-shaped interior frame structure.

46. The method of claim 29 comprising the further step of installing longitudinal supports along said desired length of said rammed earth structure.

47. The method of claim 46 comprising the further step of mounting a plurality of thickness spacers perpendicular to said longitudinal supports, upon which said first and second end stop structures may be mounted.

48. The method of claim 47 wherein said thickness spacers further comprise means to locate said first and second end stop structures in a position centered over said thickness spacers.

49. The method of claim 48 further comprising the step of securing said end stop structures to said thickness spacers in said position.

50. The method of claim 29 wherein said insulating core and said internal frame protrude from said rammed earth structure after said earth is rammed into said cavity.

51. The method of claim 29 further comprising the step of inserting a plurality of internal supports into said cavity.

52. The method of claim 51, further comprising the step of locating and drilling holes into which said internal supports may be inserted.

53. The method of claim 29, further comprising the step of inserting a form into said cavity to define a void in the rammed earth structure.

54. The method of claim 29, further comprising the steps of:

verifying the plumb of said end stop structures; and adjusting the plumb of said end stop structures.

55. The method of claim 54, wherein said step of verifying said plumb is carried out with a plumb-checking mechanism which is integral with said end stops.

56. The method of claim 55, wherein said step of adjusting the plumb of said end stop is carried out with leveling plates.

57. The method of claim 55 or 56 wherein said step of adjusting the plumb of said end stop is carried out with external braces.

58. The method of claim 29, further comprising the step of inserting an elongated strip vertically into each of said end stop structures, thereby creating shaped grooves in said rammed earth structure.

59. The method of claim 29 further comprising the step of inserting at least one interwythe connector in said insulating core before ramming earth into said cavity.

* * * * *

UNITED STATES PATENT AND TRADEMARK OFFICE

CERTIFICATE OF CORRECTION

PATENT NO. : 8,375,669 B2
APPLICATION NO. : 12/377853
DATED : February 19, 2013
INVENTOR(S) : Meror Krayenhoff It is certified that error appears in the above-identified patent and that said Letters Patent is hereby corrected as shown below:

In the Claims:

Column 12, line 49, claim '3', should read -2-

Column 12, line 57, claim '3', should read -2-

Column 14, line 30, claim '11', should read -35-

Signed and Sealed this
Fourteenth Day of May, 2013

Teresa Stanek Rea
*Acting Director of the United States Patent and Trademark Office*